US007539430B2

(12) United States Patent
Ishikuro et al.

(10) Patent No.: US 7,539,430 B2
(45) Date of Patent: May 26, 2009

(54) IMAGE FORMING APPARATUS WITH SELF COOLING FIXING SECTION

(75) Inventors: Takemasa Ishikuro, Tokyo (JP); Yujiro Iida, Tokyo (JP)

(73) Assignee: Oki Data Corporation, Tokyo (JP)

( * ) Notice: Subject to any disclaimer, the term of this patent is extended or adjusted under 35 U.S.C. 154(b) by 38 days.

(21) Appl. No.: 11/764,813

(22) Filed: Jun. 19, 2007

(65) Prior Publication Data

US 2007/0292154 A1 Dec. 20, 2007

(30) Foreign Application Priority Data

Jun. 19, 2006 (JP) ..... 2006-168624

(51) Int. Cl.
*G03G 15/20* (2006.01)

(52) U.S. Cl. ..... 399/67; 399/68; 399/69; 399/70

(58) Field of Classification Search ..... 399/67–70
See application file for complete search history.

(56) References Cited

U.S. PATENT DOCUMENTS 4,593,992 A * 6/1986 Yoshinaga et al. ..... 399/321
6,151,462 A * 11/2000 Fukuzawa et al. ..... 399/67
6,175,699 B1 * 1/2001 Kato et al. ..... 399/69
6,567,624 B1 * 5/2003 Murata ..... 399/69
6,658,222 B2 * 12/2003 Kamijo et al. ..... 399/68
6,882,808 B2 * 4/2005 Ota ..... 399/69
7,155,136 B2 * 12/2006 Nihonyanagi et al. ..... 399/69
7,361,863 B2 * 4/2008 Tsunoda ..... 219/216
2002/0141775 A1 * 10/2002 Mitsuoka et al. ..... 399/69
2004/0247335 A1 * 12/2004 Inoue et al. ..... 399/69

FOREIGN PATENT DOCUMENTS

JP 2001-146349 A 5/2001

* cited by examiner

*Primary Examiner*—David M Gray
*Assistant Examiner*—G. M. Hyder
(74) *Attorney, Agent, or Firm*—Panitch Schwarze Belisario & Nadel LLP

(57) ABSTRACT

An image forming apparatus includes a fixing section that fixes an image formed on a recording medium and a drive section that drives the fixing section in rotation. The drive section is stopped or rotated at a lower speed for reducing noise after fixing an image on the recording medium while preventing the temperature of a fixing roller from increasing.

26 Claims, 29 Drawing Sheets

IMAGE FORMING APPARATUS WITH SELF COOLING FIXING SECTION

BACKGROUND OF THE INVENTION

1. Field of the Invention

The present invention relates to image forming apparatuses such as copying machines and page printers that use a fixing unit.

2. Description of the Related Art

A conventional electrophotographic printer employs an LED print head or a laser print head for forming an electrostatic latent image. This type of electrophotographic printer includes various units that perform feeding of a recording medium, transporting of the recording medium, forming of images, fixing of the images, and discharging of the fixed recording medium. The respective units operate at speeds according to the type of medium.

Miniaturization and high printing speed are among recent trends in printer technology. One way of increasing the printing speed without additional components is to provide a sensor for detecting the trailing end of the recording medium immediately after the recording medium has passed a fixing unit. The medium is then transported at a higher speed after the recording medium has passed the fixing unit than when the recording medium is passing through the fixing unit, thereby increasing printing speed.

Another important requirement of recent printers is reduction of noise generated during printing. FIG. 31 illustrates the relation between printing speed and noise generated during printing. Noise increases as printing speed increases. This is a problem with conventional printers.

Once the medium has passed the fixing unit, the heat of a fixing roller is no longer lost to the medium and therefore the temperature of the fixing roller begins to rise. Thus, the electric power supplied to a heater element is shut off and the fixing roller is left to rotate in contact with a pressure roller for an amount of time so that the heat in the fixing roller is transferred to the pressure roller. As a result, the overshoot of the temperature of the fixing roller is minimized. From points of view of miniaturization and cost saving, the fixing roller and a medium discharging section are mostly driven by the same motor. In addition, fixing is performed at a high temperature for increasing the printing speed. This implies that the motor for the medium feeding section and image forming sections may be stopped after the medium has been discharged, but the motor for the fixing roller and the pressure roller should continue to rotate for a predetermined amount of time for preventing the fixing unit from overshooting a predetermined temperature. Extended rotation of the fixing roller and pressure roller still continues to generate annoying noise after the medium has been discharged.

SUMMARY OF THE INVENTION

An object of the invention is to solve the aforementioned problems.

Another object of the invention is to provide an image forming apparatus in which a drive motor for a fixing unit is stopped or rotated at a lower speed for reducing noise shortly after fixing while preventing the temperature of a fixing roller from increasing.

An image forming apparatus includes a fixing section, a drive section, and a controller. The fixing section fixes an image formed on a recording medium. The drive section drives the fixing section in rotation. The controller controls a speed at which the drive section drives the fixing section.

When the recording medium is passing through the fixing section, the controller controls the drive section such that the drive section drives the fixing section at a first speed. When the recording medium has passed through the fixing section, the controller controls the drive section such that the drive section drives the fixing section at a second speed, the second speed being selected in accordance with the first speed.

The image forming apparatus further includes a medium transporting section that transports the recording medium after the recording medium has passed the fixing section.

If the first speed is higher than a reference speed, the controller controls the drive section to drive the fixing section at the second speed lower than the first speed.

The controller controls the drive section to drive the fixing section in rotation for an amount of time after the recording medium has passed the fixing section, the time being determined based on either the first speed or a temperature of the fixing section when the recording medium is passing through the fixing section.

The second speed is one of a plurality of second speeds. The amount of time is selected to be smaller if a shorter one of the plurality of second speeds is selected.

The temperature of the fixing section is one of a plurality of temperatures. The amount of time is selected to be smaller if a lower of the plurality of temperatures is selected.

The fixing section includes a fixing member and a pressure member that presses the recording medium against the heating member. The image forming apparatus further includes a memory section, an operation section, and an operation section The memory section stores a first profile of temperature change and a second profile of temperature change. The first profile of temperature change describes a temperature of the fixing member with time when the fixing section continues to rotate after the recording medium has passed the fixing section. The second profile of temperature change describes a temperature of the fixing member with time when the fixing section stops rotating after the recording medium has passed the fixing section. The operation section computes an amount of time for which the controller controls the drive section to drive the fixing section in rotation after the recording medium has left the fixing section. The amount of time is computed based on the first and second profiles and a temperature of the fixing section immediately after the recording medium has passed the fixing section.

The first profile and the second profile are characteristics when the image forming apparatus is operated in an environment of a maximum temperature above which the image forming apparatus is not guaranteed to operate normally. The first profile and the second profile are such that the controller controls the drive section to drive the fixing section for a shorter time with decreasing temperature of the fixing section immediately after the recording medium has passed the fixing section.

The image forming apparatus further includes a detector that detects a temperature of an environment in which the image forming apparatus operates. The controller controls an amount of time for which the controller controls the drive section to drive the fixing section in rotation after the recording medium has passed the fixing section. The amount of time is controlled based on the temperature detected by the detector.

The controller controls the drive section to drive the fixing section for a shorter time with decreasing temperature of the environment.

The fixing section includes a fixing member and a pressure member that presses the recording medium against the fixing member, the fixing section includes a detector that detects a temperature of the pressure member. The controller controls the drive section to drive the fixing section for an amount of time based on the temperature of the pressure member after the recording medium has left the fixing section.

The controller controls the drive section to drive the fixing section for a shorter time with decreasing temperature of the pressure member immediately after the recording medium has passed the fixing section.

The fixing section includes a fixing member and a first detector that detects a temperature of the fixing member and a second detector that detects an atmospheric temperature within the fixing section. The controller controls the drive section to drive the fixing section for an amount of time based on the temperature detected by the second detector.

The controller controls the drive section to drive the fixing section for a shorter time with decreasing temperature detected by the second detector immediately after the recording medium has passed the fixing section.

The first detector is away from the fixing member.

The detector that detects a temperature of the environment is disposed within the image forming apparatus and in the vicinity of an air hole formed in an outer housing wall of the image forming apparatus.

The detector that detects a temperature of the environment is disposed below the fixing section in a gravitational direction.

The detector that detects a temperature of the environment is disposed upstream of the fixing section with respect to a transport path of the recording medium.

The drive section drives the medium transporting section

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DESCRIPTION OF THE INVENTION

First Embodiment

{General Configuration}

Figure 1:
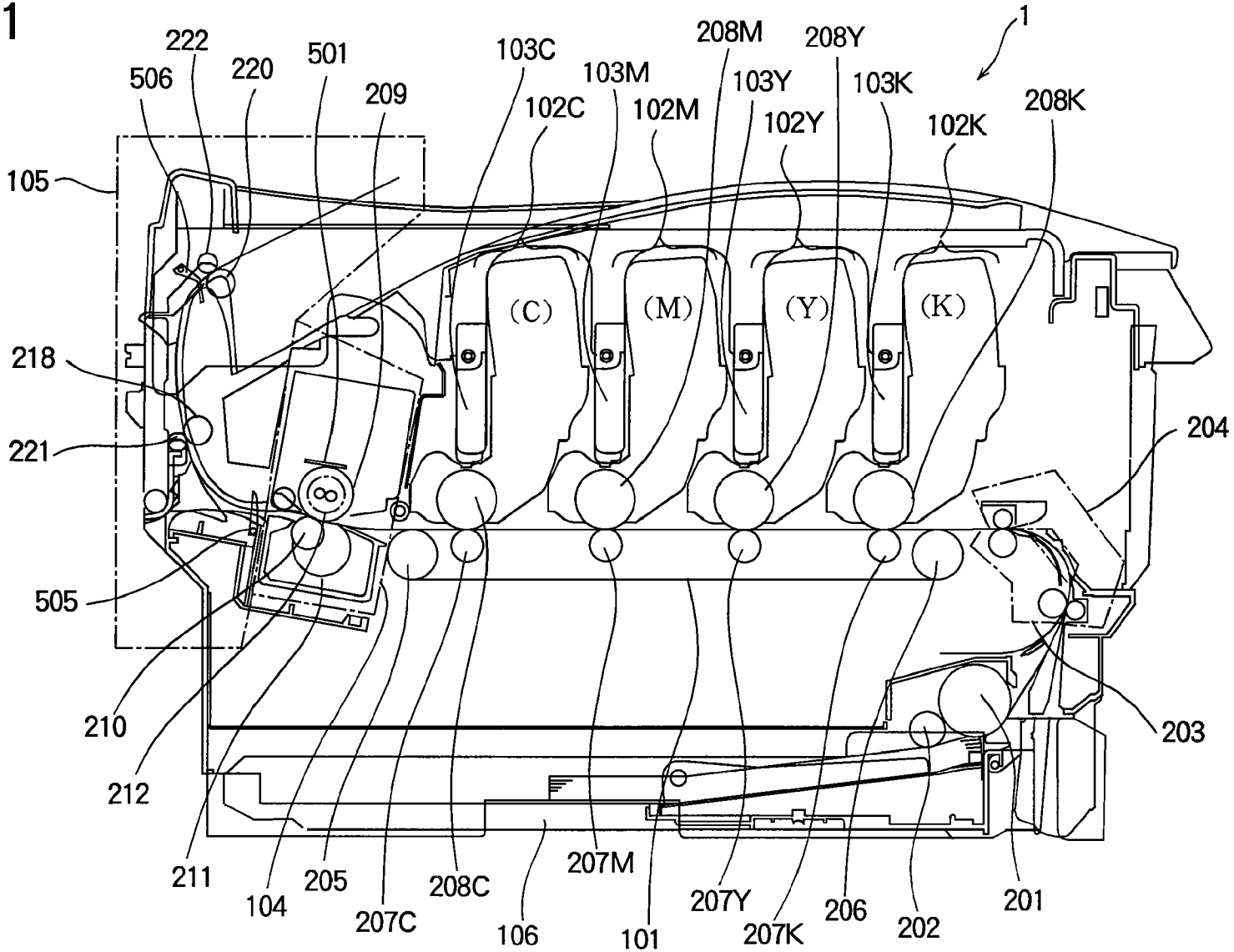
FIG. 1 is a general configuration of an image forming apparatus of a first embodiment.

FIG. 1 is a general configuration of an image forming apparatus 1 of a first embodiment.

The image forming apparatus 1 is a tandem type color electrophotographic printer that employs an LED print head. A medium cassette 106 includes a sheet support platform upwardly urged by a spring (not shown), a paper-feeding mechanism that includes a paper feeding roller 201, and a paper feeding sub-roller 202, which are arranged such that a stack of paper is sandwiched between the paper-feeding mechanism and the sheet support platform. Registration rollers 203 and pinch rollers 204 cooperate with each other to hold paper and transport the paper to the image forming section. A transport belt 101 is entrained about a belt drive roller 205 and an idle roller 206, and is maintained in tension. The transport belt 101 forms a transport path of the paper.

Image drum units (ID units) 102K, 102Y, 102M, and 102C are aligned along the transport path, and form black (K), yellow (Y), magenta (M), and cyan (C) images, respectively. The ID units 102K, 102Y, 102M, and 102C include photoconductive drums 208K, 208Y, 208M, and 208C, respectively, which extend in parallel with corresponding transfer rollers 207K, 207Y, 207M, and 207C, respectively. The ID units 102K, 102Y, 102M, and 102C also include LED print heads 103K, 103Y, 103M, and 103C, respectively, that illuminate the charged surfaces of the photoconductive drums 208K, 208Y, 208M, and 208C to form electrostatic latent images of corresponding colors.

Figure 2:
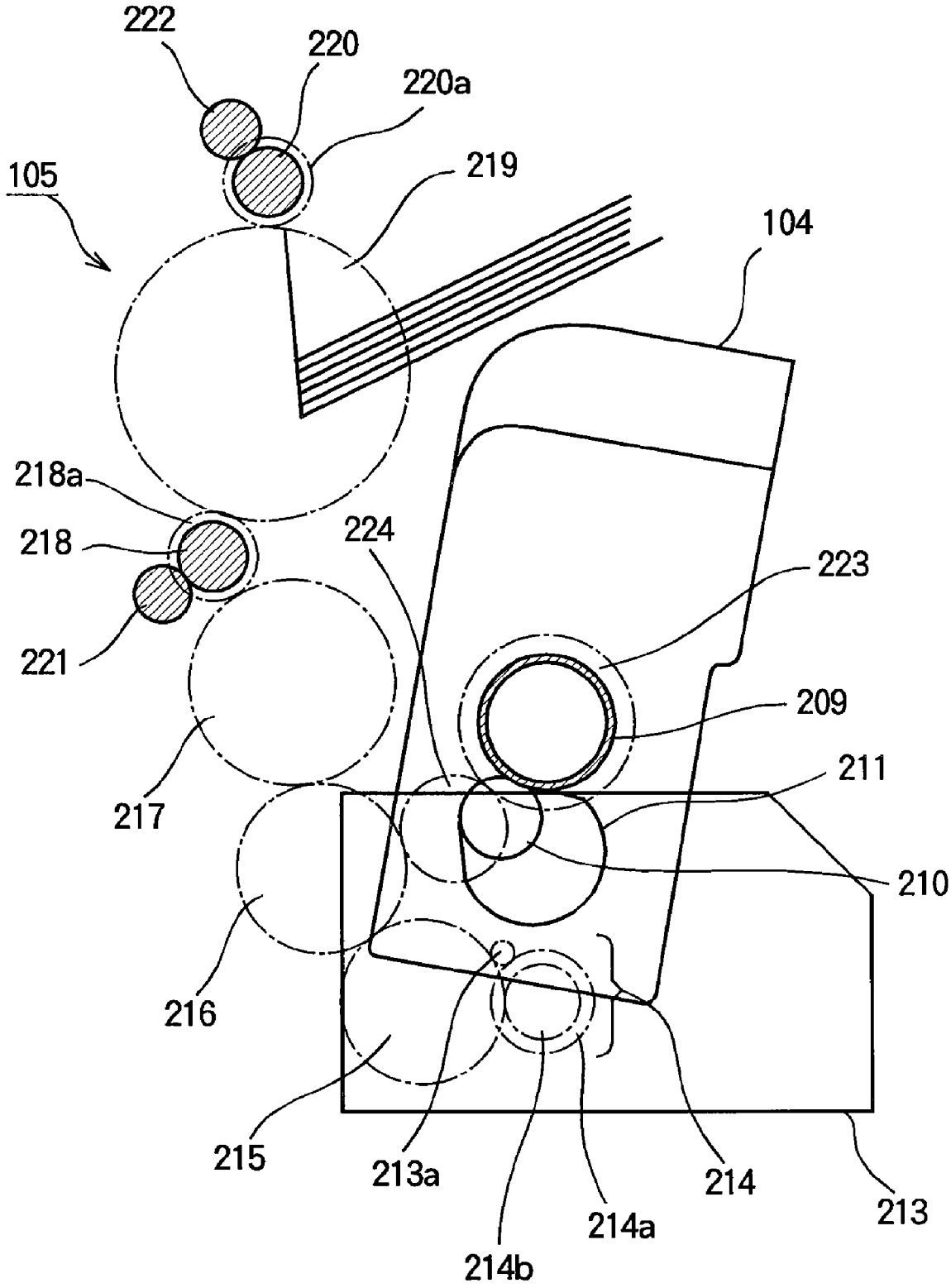
FIG. 2 illustrates a pertinent portion of a gear train driven by a single motor, the gear train driving the fixing unit and discharging unit.

The ID units 102K, 102Y, 102M, and 102C are driven by a single ID motor (not shown), and transfers toner images onto the paper while also transporting the recording medium. A fixing unit 104 includes a fixing roller 209, a pressure roller 210, and a fixing belt 211 driven by a fixing motor 213 (FIG. 2). The fixing belt 211 is entrained about the pressure roller 210, and rotates in contact with the fixing roller 209 to form a nip between the fixing belt 211 and the fixing roller 209. A heater 212 is provided in the fixing roller 209. When the medium advances through the nip defined between the fixing roller and the fixing belt 211, the heater 212 heats the fixing roller 209 such that the toner images on the medium is fused under heat and pressure into a permanent full color image.

The fixing roller 209 includes a metal core formed of, for example, iron or aluminum, covered with a resilient body formed of, for example, silicone rubber. The resilient body is covered with a film of fluoroplastic that prevents toner, which failed to be fused properly, from adhering thereto. The pressure roller 210 includes a metal core formed of, for example, iron or aluminum, covered with a resilient body formed of, for example, silicone rubber. The fixing belt 211 is formed of a thin sheet of polyimide resin covered with fluoroplastic. The fluoroplastic prevents residual toner, which is not fused and remains on the fixing roller 209, from adhering to the medium when a jamming occurs during transportation of medium. A fixing thermistor 501 is disposed in proximity to the fixing roller 209, and detects the surface temperature of the fixing roller 209. In accordance with the temperature detected by the fixing thermistor 501, control is made to switch on and off the electric power supplied to the heater 212.

A discharging unit 105 is disposed downstream of the fixing unit 104, and discharges the paper out of the image forming apparatus 1 in a stacked manner. The discharging unit 105 includes discharge rollers 218 and 220 that transport the medium, and pinch rollers 221 and 222 that cooperate with the discharge rollers 2118 and 220, respectively. A medium leading end sensor 505 is located downstream of the fixing unit 104 and in the vicinity of the fixing unit 104, and detects the medium. A medium trailing end sensor 506 is disposed immediately upstream of the discharge roller 220, and detects when the medium has passed the medium trailing end sensor 506 to be discharged onto a stacker. The medium leading end sensor 505 and medium trailing end sensor 506 are located so that the medium within the discharging unit 105 is reliably detected.

FIG. 2 illustrates a pertinent portion of a gear train driven by a single motor, the gear train driving the fixing unit 104 and discharging unit 105. The drive force generated by the motor 213 is transmitted through a motor gear 213*a* to the gear 214. The gear 214 includes a gear 214*a* in mesh with the motor gear 213*a* and a gear 214*b* that transmits the rotation of the motor gear 213*a* to an idle gear 215. The idle gear 215 is in mesh with a gear 216 through which rotation is transmitted to a fixing roller gear 223 via the idle gear 224, and through which rotation is transmitted to the discharging gears 218*a* and 220*a* of the discharge rollers 218 and 220, respectively, via idle gears 217 and 219.

Figure 3:
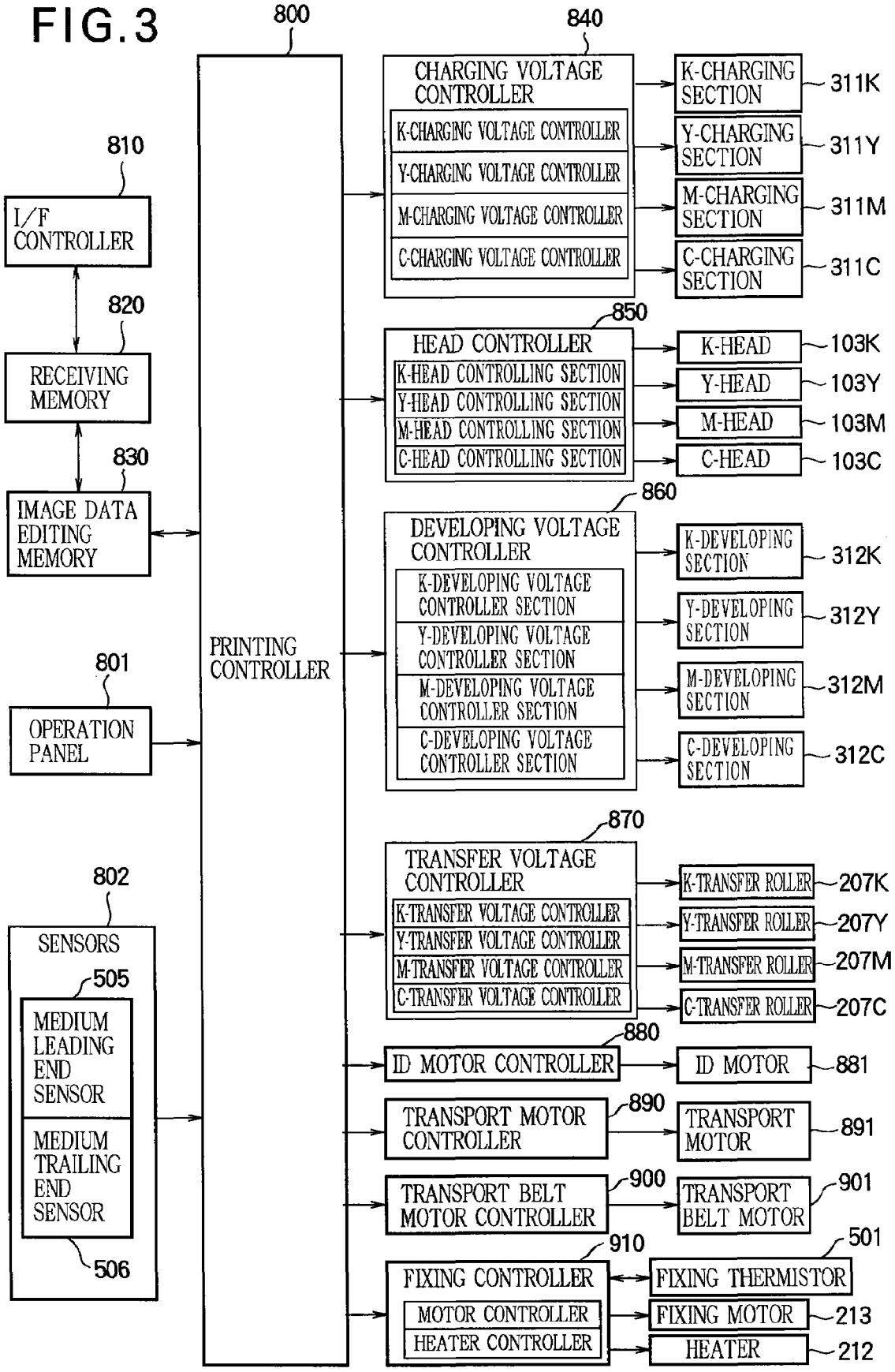
FIG. 3 is a block diagram illustrating the configuration of a control system that controls the pertinent portion of the invention.

FIG. 3 is a block diagram illustrating the configuration of a control system that controls the pertinent portion of the invention.

Referring to FIG. 3, a printing controller 800 includes primarily a micro processor, a ROM, a RAM, an input/output (I/O) port, and a timer. The printing controller 800 receives print data and control commands from a host apparatus, and sequentially controls the overall operation for printing. An I/F controller 810 transmits printer information to the host apparatus, and analyzes the commands received from the host apparatus and processes the data received from the host apparatus. A receiving memory 820 stores the data received from the host apparatus according to color, under the control of the I/F controller 810. The operation panel 801 includes LEDs that indicate the status of the image forming apparatus, and switches for the operator to send commands to the image forming apparatus.

Sensors 802 include the medium leading end sensor 505 that detects the position of the medium, the medium trailing end sensor 506, sensors that detect temperature and humidity within the apparatus, and sensors that detect the density of images. The print data is received from the host apparatus through the I/F controller 810, and is edited into image data. In other words, the print data is temporarily held in the receiving memory 820, and is then edited into image data. An image data editing memory 830 stores edited image data, and sends the image data to the LED print head 103 (FIG. 1).

A charging voltage controller 840 applies voltages to the charging units in the ID units 102K, 102Y, 102M, and 102C, thereby charging the surfaces of the photoconductive drums 208K, 208Y, 208M, and 208C, respectively. The charging voltage controller 840 includes K-, Y-, M-, and C-charging voltage controlling sections, which are connected to K-, Y-, M-, and C-charging sections 311K, 311Y, 311M, and 311C, and which control the voltages applied to these charging sections.

A head controller 850 performs control in which the LED print heads 103K, 103Y, 103M, and 103C illuminate the corresponding charged surfaces of the photoconductive drums in accordance with the image data stored in the image data editing memory 830. The head controller 850 includes K-, Y-, M-, and C-head controlling sections, which are connected to K-, Y-, M-, and C-heads, and which control the transmission of image data to these heads.

A developing voltage controller 860 performs control in which voltages are applied to the developing sections 312K, 312Y, 312M, and 312C, respectively. The developing voltage controller 860 includes K-, Y-, M-, and C-developing voltage controlling sections, which are connected to developing sections 312K, 312Y, 312M, and 312C, and which control the voltages applied to these developing sections to form toner images of the corresponding colors.

A transfer voltage controller 870 performs control in which voltages are applied to the transfer rollers 207K, 207Y, 207M, and 207C. The transfer voltage controller 870 includes K-, Y-, M-, and C-transfer voltage controlling sections, which are connected to transfer rollers 207K, 207Y, 207M, and 207C, and which control the voltages applied to these transfer rollers to transfer the toner images of the corresponding colors onto the medium.

An I/D motor controller 880 performs control in which an ID motor 881 is controlled to drive the photoconductive drums 208K, 208Y, 208M, and 208C, charging sections 311K, 311Y, 311M, and 311C, and developing sections 312K, 312Y, 312M, and 312C. A transport motor controller 890 performs control in which a transport motor 891 is controlled to feed medium and transport the medium to the image forming sections. A transport belt motor controller 900 controls a transport belt motor 901 to transport the medium onto which the toner image has been transferred.

A fixing controller 910 performs control in which the toner image on the medium is fused into a permanent image. The fixing controller 910 receives the temperature signal indicative of the detected temperature from the fixing thermistor 501 (FIG. 1) for detecting the temperature of the fixing unit 104, and then switches on and off the voltage applied to the heater 212 in the fixing unit 104 in accordance with the temperature signal. When the fixing unit 104 reaches a predetermined temperature or at a later described timing, the fixing controller 910 controls the fixing motor 213. In this manner, the fixing motor 213 is controlled by the printing controller 800 and the fixing controller 910.

The printing controller 800 receives control commands and print data from the host apparatus through the I/F controller 810. Upon receiving a print command from the host apparatus, the printing controller 800 determines a circumferential speed of the fixing roller 209 based on the print information received from the host apparatus. The circumferential speed V is such that the toner image on the recording medium is sufficiently fused. The circumferential speed V is selected from V1=180 mm/sec, V2=155 mm/sec, V3=120 mm/sec, and V4=95 mm/sec depending on the thickness and type of the medium contained in the print information. The circumferential speeds V1, V2, V3, and V4 are related such that V1>V2>V3>V4. For a recording medium (e.g., paper) of a grammage of 70 g/m$^2$, the circumferential speed V may be selected from V1=180 mm/sec, V2=155 mm/sec, V3=120 mm/sec, and V4=95 mm/sec. The fixing temperature T is selected to be 190° C. and a rotation time tr for which the fixing roller 209 continues to be rotated for cooling down the fixing roller 209 after discharging the recording medium is selected to be 15 seconds.

The rotation time tr will be described. The temperature of the fixing unit 104 begins to increase shortly after the medium has passed through the fixing unit 104 if the heater remains energized. Thus, the heater 212 is shutoff, and the fixing roller 209 and pressure roller 210 continue to rotate so that the heat in the fixing roller 209 is lost to the pressure roller 210, minimizing the overshooting of the temperature of the fixing roller 209. The rotation time tr is an amount of time for which the fixing motor 213 continues to rotate the fixing roller 209 after the recording medium has passed the fixing unit 104.

{Operation}

Figure 4:
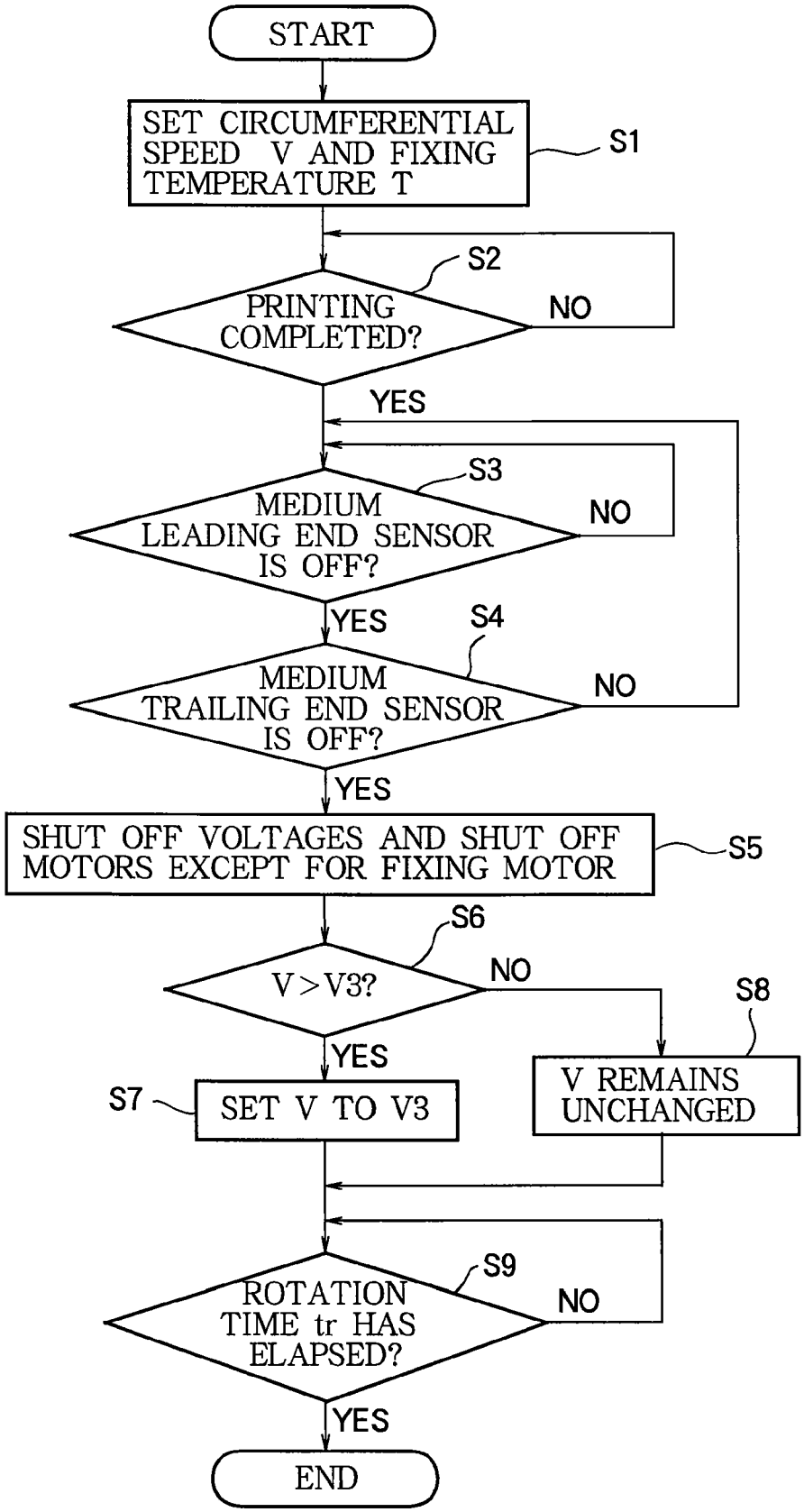
FIG. 4 illustrates the operation of the image forming apparatus of the first embodiment.

FIG. 4 illustrates the operation of the image forming apparatus. The operation of the image forming apparatus of the aforementioned configuration will be described with reference to FIG. 4.

Step S1: The printing controller 800 receives the control commands and print data from the host apparatus via the I/F controller 810. Upon receiving a print command from the host apparatus, the printing controller 800 checks the received print information to detect the circumferential speed V and the fixing temperature T (e.g., T=190° C.). The circumferential speed V is selected from among V1=180 mm/sec, V2=155 mm/sec, V3=120 mm/sec, and V4=95 mm/sec according to the printing speed. The circumferential speeds V are listed in a table stored in a memory of the printing controller 800. For example, when monochrome printing is to be performed, the circumferential speed V is selected to be V1. When color printing is to be performed, the circumferential speed is selected to be V2. When the recording medium has a rough surface, the circumferential speed is selected to be V3. When the recording medium has a width not greater than 210 mm, the circumferential speed is selected to be V4. While the first embodiment will be described with respect to medium of a grammage of 70 g/m$^2$, the circumferential speeds V1-V4 may be changed as required depending on the thickness and type of recording medium (e.g., ordinary medium, transparency)

A description will be given of the printing operation after the printing conditions are set at step S1 until completion of printing is detected at step S2.

The printing controller 800 sends a command to the fixing controller 910, which in turn receives a temperature signal indicative of the detected temperature from the fixing thermistor 501 (FIG. 1) and determines whether the temperature of the fixing roller 209 is within the range in which fixing may be performed properly. If the temperature is below a lower end of the range, the heater 212 is turned on to heat the fixing roller 209 until the temperature of the fixing roller 209 is within the range. When the temperature reaches a predetermined fixing temperature (e.g., T=190° C.), the fixing controller 910 begins to control the fixing motor 213 to drive the fixing roller 209 in rotation, so that the printing is performed at a circumferential speed of the fixing roller 209.

The printing controller 800 drives the ID motor controller 880 and the transport belt motor controller 900, thereby driving the photoconductive drums 208K, 208Y, 208M, and 208C, the charging sections 311K, 311Y, 311M, and 311C, the ID motor 881 for the developing sections 312K, 312Y, 312M, and 312C, and the transport belt motor 901 for performing printing at the circumferential speed V. At the same time, the printing controller 800 sends commands to the charging voltage controller 840, developing voltage controller 860, transfer voltage controller 870, which in turn apply voltages to the charging sections 311K, 311Y, 311M, and 311C, the developing sections 312K, 312Y, 312M, and 312C, and the transfer rollers 207K, 207Y, 207M, and 207C, respectively. Then, the printing controller 800 sends a command to the transport motor controller 890, which in turn begins to feed the recording medium of an appropriate size and a type from the medium cassette 106 (FIG. 1) into the transport path. The size and type of the recording medium accommodated in the medium cassette 106 are detected by a remaining medium sensor and a medium size sensor, respectively. In the first embodiment, when color printing is to be performed on paper of a grammage of 70 g/m$^2$, the circumferential speed V is set to V2=155 mm/sec.

The transport motor 891 is first driven to rotate in a reverse direction such that the recording medium is advanced from the medium cassette until a sensor (not shown) detects the medium. The transport motor 891 is then driven in rotation in a forward direction such that the recording medium is further advanced toward the ID units.

As soon as the recording medium has reached a position where printing may be performed, the printing controller 800 sends timing signals to the image data editing memory 830 to read the image data from the image data editing memory 830, and then sends the image data from the image data editing memory 830 to the head controller 850. Upon receiving image data for one line, the head controller 850 sends a latch signal to the LED print heads 103K, 103Y, 103M, and 103C so that the image data for one line is held into the LED print heads 103K, 103Y, 103M, and 103C. Then, the head controller 850 sends a drive signal STB to the LED print heads 103K, 103Y, 103M, and 103C before receiving the next timing signal from the printing controller 800. The LED print heads 103K, 103Y, 103M, and 103C illuminate the surfaces of the photoconductive drums 208K, 208Y, 208M, and 208C, respectively, in accordance with the image data held therein, thereby forming one line of electrostatic latent image.

The charges on the surfaces of the photoconductive drums 208K, 208Y, 208M, and 208C illuminated by the LED print heads 103K, 103Y, 103M, and 103C, respectively, are dissipated to increase in potential to form dots of electrostatic latent image. The dots of electrostatic latent image formed on the photoconductive drums 208K, 208Y, 208M, and 208C, respectively, attract by Coulomb force toner particles negatively charged by the developing sections 312K, 312Y, 312M, and 312C, respectively, thereby forming toner images of the respective colors. As the photoconductive drums 208K, 208Y, 208M, and 208C rotate, the respective toner images approach transfer points defined between the photoconductive drums and corresponding transfer rollers. The printing controller 800 sends a command to the transfer voltage controller 870, which in turn apply positive high voltages to the transfer rollers 207K, 207Y, 207M, and 207C, respectively, so that the toner images of the respective colors are transferred by the corresponding transfer rollers 207K, 207Y, 207M, and 207C onto the recording medium. The recording medium having toner images of the respective colors thereon advances to the fixing unit 104 where the toner images are fused under pressure and heat at the fixing temperature T into a full color permanent image. Then, the recording medium is further advanced into the discharging unit 105 (FIG. 1). When the medium leading end sensor 505 and the medium trailing end sensor 506 no longer detect the recording medium, it is determined that the recording medium has been discharged to the outside of the image forming apparatus 1.

Step S2: A check is made to determine whether printing of a specified number of pages has been completed. If the printing has not been completed yet, the program continues to print at the circumferential speed V and fixing temperature T until all of the specified number of pages has been printed.

Steps S3-S4: If the printing has been completed, the program proceeds to step S3 and then step S4 where a check is made based on the medium leading end sensor 505 and the medium trailing end sensor 506 to determine whether the recording medium remains within the discharging unit 105.

Step S5: If the recording medium does not remain within the discharging unit 105, then the program proceeds to step S5 where high voltage supplied to the charging sections 311K, 311Y, 311M, and 311C, the developing sections 312K, 312Y, 312M, and 312C, the transfer rollers 207K, 207Y, 207M, and 207C, and the electric power supplied to the heater 212 are shut off and the motors except for the fixing motor 213 are shut off.

The medium leading end sensor 505 and the medium trailing end sensor 506 continue to generate detection signals as long as the recording medium is passing by these sensors. Therefore, when the trailing end of the recording medium advances past the medium trailing end sensor 506, it is determined that no recording medium is remaining in the discharging unit 105.

Step S6: A check is made to determine whether the circumferential speed V is higher than a predetermined threshold V3.

Step S7: If V>V3 (YES at S6), then the program proceeds to step S7 where the circumferential speed V is set to V3 and the rotation time tr is set to 15 seconds.

Step S8: If V≦V3 (NO at S6), the program proceeds to step S8 where the circumferential speed V remains unchanged and the rotation time tr is set.

Step S9: A check is made to determine whether the rotation time tr has elapsed. If the rotation time tr has elapsed, the fixing controller 910 controls the fixing motor 213 to stop rotating. Then, the program waits for the next print command.

Figure 5:
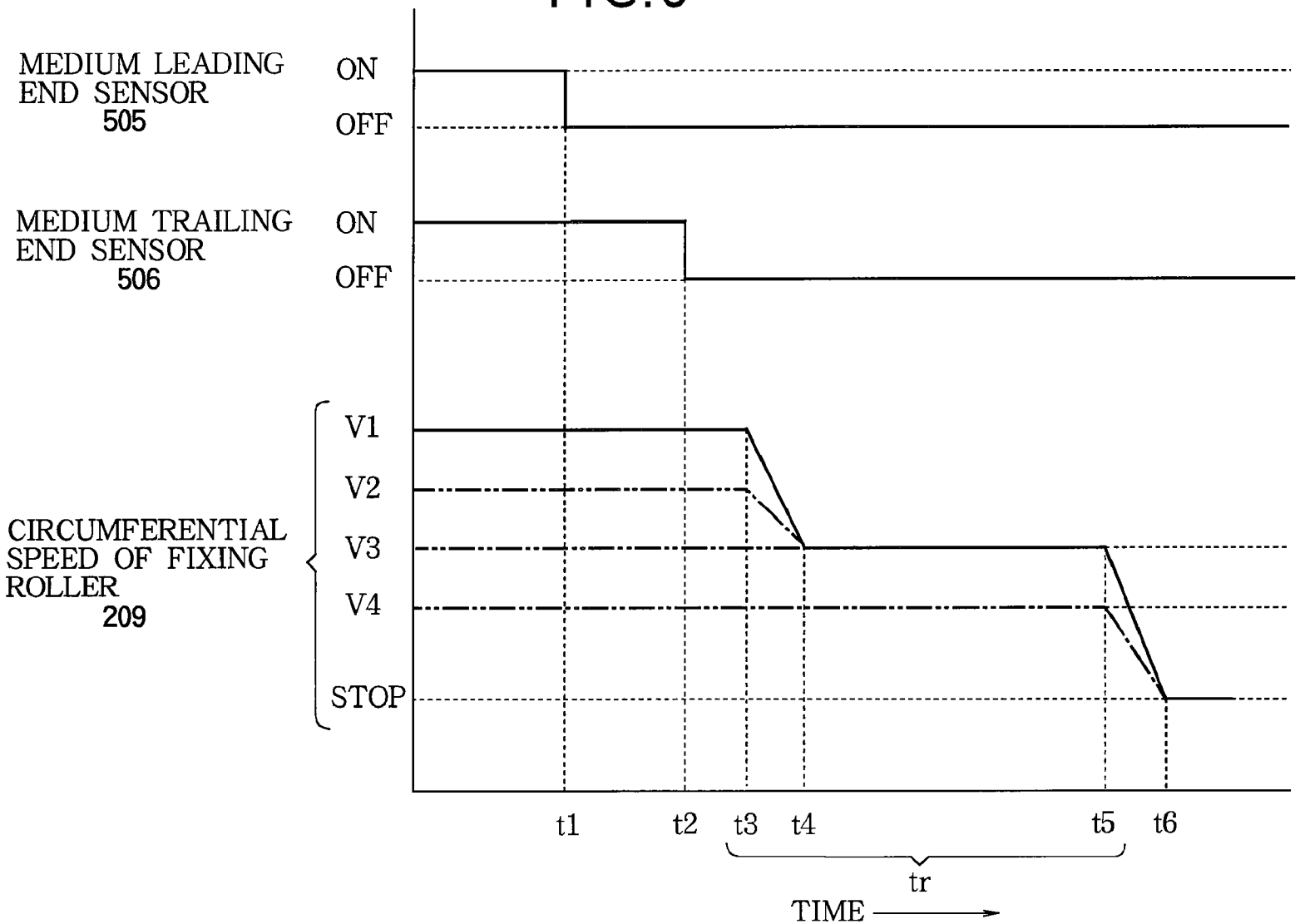
FIG. 5 illustrates a timing chart in accordance with the flowchart of FIG. 4.

FIG. 5 illustrates a timing chart in accordance with the flowchart of FIG. 4.

Referring to FIG. 5, the output of the medium leading end sensor 505 becomes OFF at time t1 and the output of the medium trailing end sensor 506 becomes OFF at time t2. At time t2, the printing controller 800 determines that no recording medium stays in the discharging unit 105. The printing controller 800 sets the circumferential speed V at time t3 (steps S6-S8 in FIG. 4). If V=V1 or V2 higher than V3, the V reaches V3 at time t4 and speed reduction completes. Then, the electric power to the fixing motor 213 is shut off at time t5 so that the fixing motor 213 comes to a stop at time t6. The time (t3 to t4) required for reducing the speed of the fixing motor 213 and the time (t5 to t6) required for stopping the fixing motor 213 are approximately 0.2 seconds. The rotation time tr (t3 to t5) is 15 seconds.

As is clear from FIGS. 4 and 5, when it is determined that no recording medium is remaining in the discharging unit 105, if V is higher than V3, the circumferential speed V is set to V3. The fixing motor 213 continues to rotate for the rotation time tr. If, for example, the circumferential speed V is V4 lower than V3, the circumferential speed V remains unchanged and the fixing motor 213 continues to rotate for the rotation time tr, and then stops rotating.

In the first embodiment, the fixing motor 213 stops rotating after the rotation time tr. However, if the next print job is received in the middle of the rotation time tr, the cooling operation is interrupted and the apparatus prepares for the next printing operation.

Generally speaking, the noise level in an ordinary office is about 50 dB. The circumferential speed V3 is preferably set to a value such that the noise level is less than 52 dB. However, as long as the fixing temperature does not overshoot to an abnormal temperature Ta, the circumferential speed should be as low as possible for minimizing noise level. The circumferential speed V of the fixing motor 213 for cooling purpose may be set to various values lower than that during printing.

As described above, the fixing motor 213 continues to rotate at a predetermined circumferential speed when the recording medium is passing through the fixing unit 104 and is rotated at a reduced speed after the recording medium has been discharged from the fixing unit 104. Thus, printing may be performed at a predetermined printing speed, and the fixing unit 104 and the discharging unit 105 may be operated with minimum noise level after the recording medium has left the fixing unit 104.

Second Embodiment

In the first embodiment, the rotation time rt is a fixed value. Actually, the shorter the rotation time tr, the earlier the fixing motor 213 may come to a stop. This is desirable for the user. However, if the fixing motor 213 comes to a stop early, the temperature of the fixing roller 209 may exceed an abnormal temperature due to overshoot.

Figure 6:
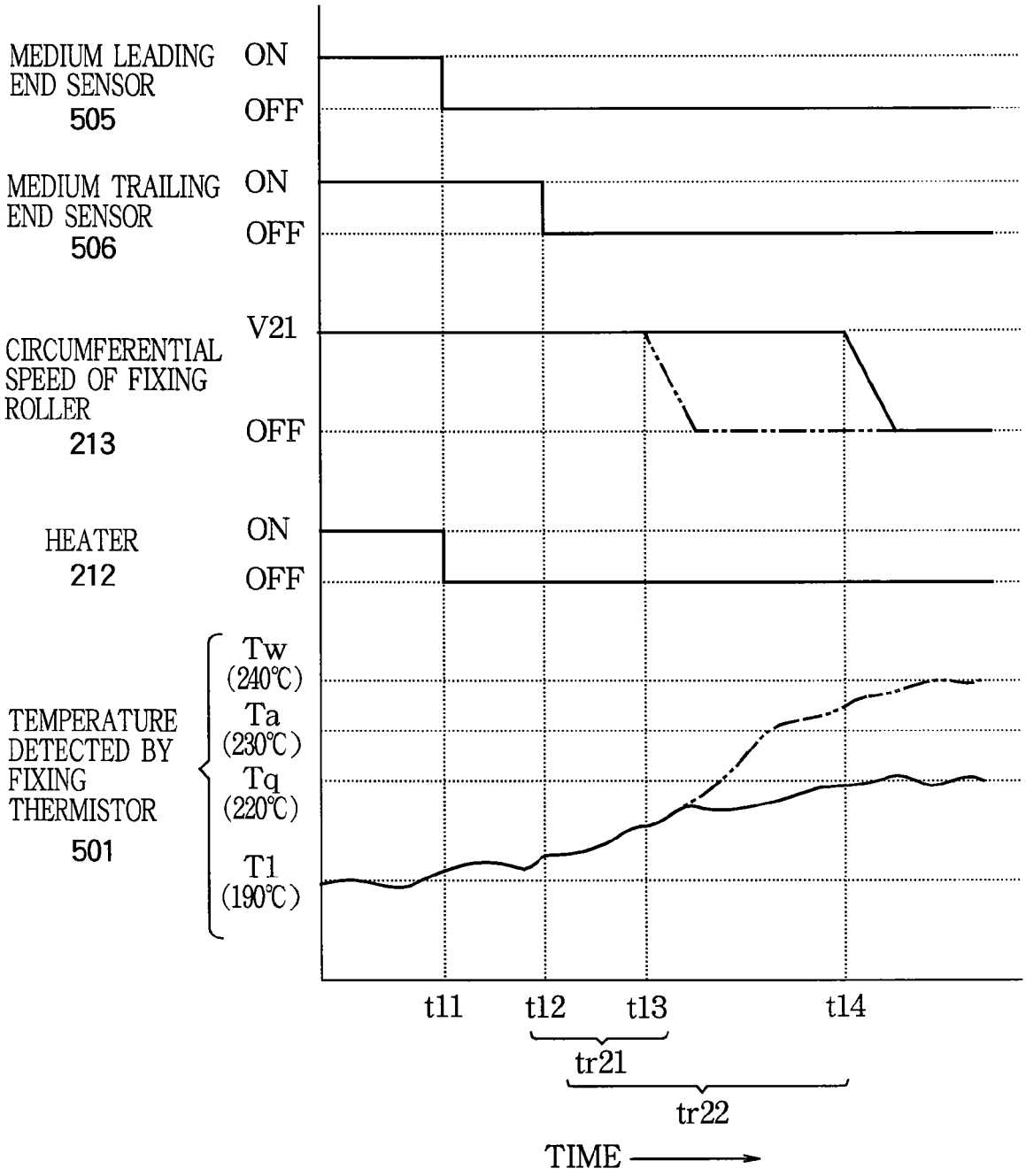
FIG. 6 illustrates the operations of a medium leading end sensor, a medium trailing end sensor, a fixing motor, a heater, and a thermistor in relation with the rotation time of the fixing roller.

FIG. 6 illustrates the operations of the medium leading end sensor 505, the medium trailing end sensor 506, the fixing motor 213, the heater 212, and the fixing thermistor 501 in relation with the rotation time tr.

The following are assumed tr21 is 5 seconds (from t12 to t13)

tr22 is 15 seconds (from t12 to t14)

Ta is an abnormal temperature of the fixing roller 209 detected by the fixing thermistor 501, and is 230° C.

T21 is a fixing temperature, and is 190° C.

For rotation time tr22=15 sec, a maximum temperature Tq due to overshoot detected by the fixing thermistor 501 is 220° C. For rotation time tr21=5 sec, a maximum temperature Tw due to overshoot detected by the fixing thermistor 501 is 240° C., exceeding the abnormal temperature Ta. The maximum temperature Tw brings the image forming apparatus 1 into an abnormal state where print quality is poor, for example. Thus, Ta is an upper end of the temperature range within which the image forming apparatus operates properly. Therefore, the rotation time tr must be selected to ensure that a rise in fixing temperature due to overshoot will not reach Ta.

The fixing temperature is selected depending on the amount of heat per unit time supplied to the recording medium when the recording medium passes through the fixing point defined between the fixing roller 209 and the pressure roller 210. In other words, the circumferential speed and fixing temperature should be selected according to various types of recording media including special paper such as thick paper, post cards, transparencies, and paper having a narrow width such as A5 size paper and A6 size paper. When the fixing temperature is 190° C., an overshoot ΔTw for tr21=5 sec is given based on a maximum temperature Tw (240° C.), and an overshoot ΔTq for tr22=15 sec is given based on a maximum temperature (220° C.) Tq as follows:

$$\Delta Tw=(Tw-T1)=(240-190)=50^\circ\text{ C.}$$

$$\Delta Tq=(Tq-T1)=(220-190)=30^\circ\text{ C.}$$

Thus, an optimum value of rotation time tr may be set depending on the fixing temperature T.

An image forming apparatus of the second embodiment has the same configuration of the control system as that of the first embodiment. The second embodiment differs from the first embodiment only in the printing process performed by the printing controller 800.

The image forming apparatus of the second embodiment will be described with reference to FIGS. 1 to 3.

Referring to FIG. 3, the printing controller 800 receives control commands and print data from a host apparatus through an I/F controller 810. Upon receiving a print command from the host apparatus, the printing controller 800 determines the circumferential speed V of the fixing roller 209 and the fixing temperature T based on the received print information. The circumferential speed is selected according to printing speed from among V21 to V24 and the fixing temperature is selected from among T21 to T24. The circumferential speeds V21, V22, V23, and V24 are related such that V21>V22>V23>V24. When the circumferential speed V is low, a larger amount of heat is transferred from the fixing roller 209 to the recording medium so that the fixing temperature T may be set to lower temperatures. The fixing temperatures T21, T22, T23, and T24 are related such that T21>T22>T23>T24. The rotation time is selected according to the circumferential speed V from tr21-tr24, which are related such that tr21>tr22>tr23>tr24.

For a recording medium of a grammage of 70 g/m$^2$, appropriate printing conditions are set as follows:

An appropriate circumferential speed according to the printing speed may be selected from among V21=180 mm/sec, V22=155 mm/sec, V23=120 mm/sec, and V24=95 mm/sec.

An appropriate fixing temperature T may be selected from among T21=190° C., T22=185° C., T23=177° C., and T24=170° C.

An appropriate rotation time tr may be selected from among tr21=15 sec, tr22=12 sec, tr23=10 sec, and tr24=7 sec.

Figure 7:
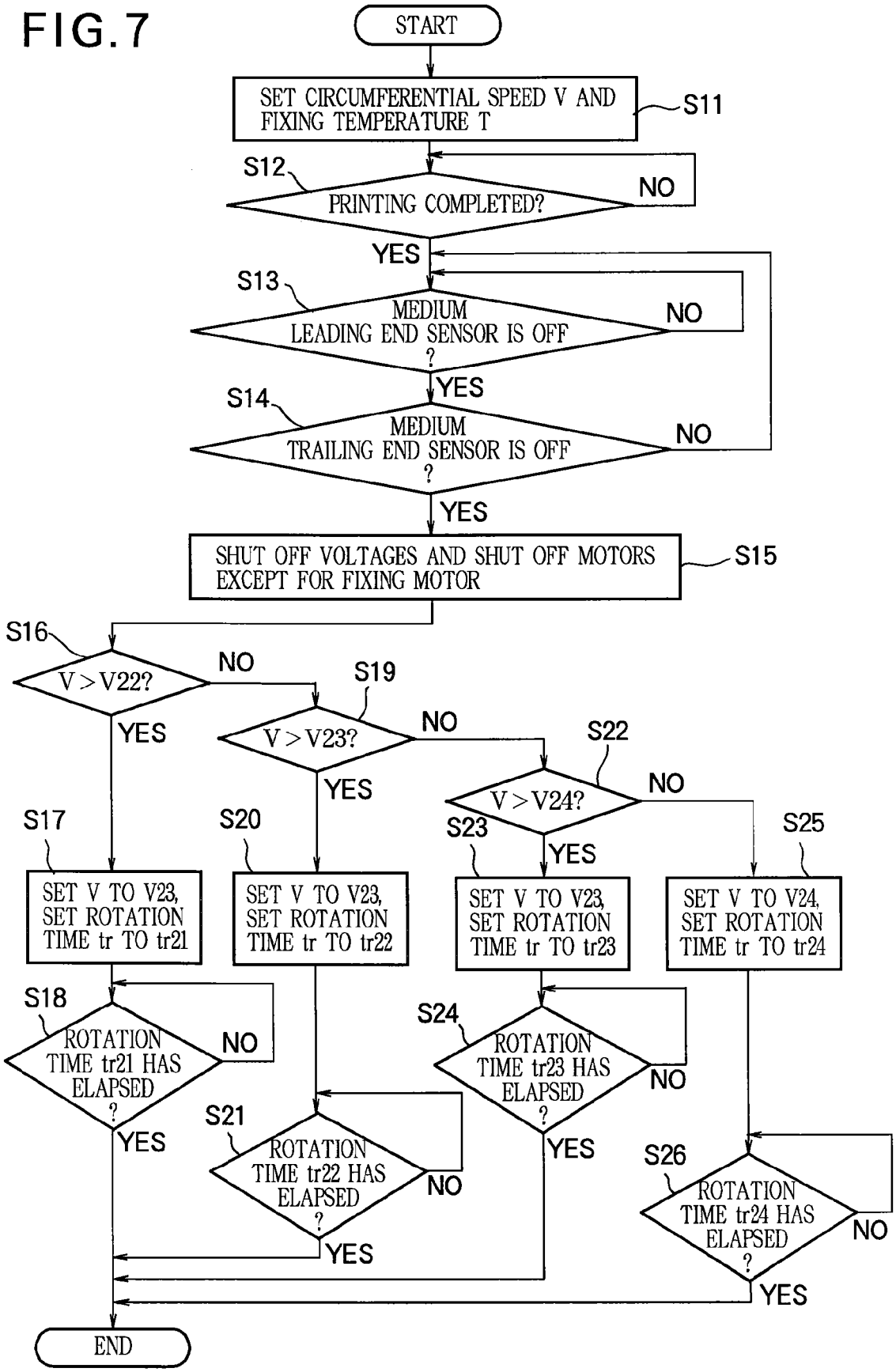
FIG. 7 illustrates the operation of the image forming apparatus of a second embodiment.

FIG. 7 illustrates the operation of the image forming apparatus of the second embodiment. The operation of the image forming apparatus 1 of the second embodiment of the aforementioned configuration will be described with reference to the flowchart illustrated in FIG. 7.

The printing controller 800 receives control commands and print data from the host apparatus through the I/F controller 810. Upon receiving a print command from the host apparatus, the printing controller 800 selects a circumferential speed V of a fixing roller 209 from among V21 to V24, and a fixing temperature T is selected from among T21 to T24 (step S11) . The four different circumferential speeds V21-V24 and four different fixing temperatures T21-T24 are listed in a table stored in a memory area of the printing controller 800.

The normal printing is performed after selection of printing conditions at step S11 until completion of the printing at step S12. The printing operation is the same as that described with reference to the flowchart shown in FIG. 4 and therefore the description is omitted.

Step S12: A check is made to determine whether printing has been completed for the number of pages specified by the received print command. If NO, printing is continued at the circumferential speed V and the fixing temperature T. If YES, the program proceeds to step S13.

Steps S13 and S14: A check is made based on the outputs of the medium leading end sensor 505 and medium trailing end sensor 506 to determine whether the recording medium remains in the discharging unit 105. If the recording medium has been discharged from the discharging unit 105, the program proceeds to step S15.

Step S15: The voltages applied to the charging section 311K, 311Y, 311M, and 311C, developing section 312K, 312Y, 312M, and 312C, transfer rollers 207K, 207Y, 207M, and 207C, and heater 212 are shut off, and motors except for the fixing motor 213 are also shut off.

The medium leading end sensor 505 and medium trailing end sensor 506 continue to generate detection signals (i.e., ON signal) when the recording medium is passing by these sensors. Therefore, when the trailing end of the recording medium has advanced past the medium trailing end sensor 506, it is determined that no recording medium is remaining in the discharging unit 105.

Step S16: A check is made to determine whether the circumferential speed V is higher than a predetermined threshold V22. If V>V22 (YES at S16), then the program proceeds to step S17. If V≦V22 (NO at S16), then the program proceeds to step S19.

Step S17: The circumferential speed V is set to V23 and the rotation time tr is set to tr21 (i.e., 15 sec).

Step S18: A check is made to determine whether the rotation time tr21 is reached. If YES, the fixing motor 213 is stopped.

Step S19: A check is made to determine whether the circumferential speed V is higher than a predetermined threshold V23. If V>V23 (YES at S19), then the program proceeds to step S20. If V≦V23 (NO at S19), then the program proceeds to step S22.

Step S20: The circumferential speed V is set to V23 and the rotation time tr is set to tr22.

Step S21: A check is made to determine whether the rotation time tr22 is reached. If YES, the fixing motor 213 is stopped.

Step S22: A check is made to determine whether the circumferential speed V is higher than a predetermined threshold V24. If V>V24 (YES at S22), then the program proceeds to step S23. If V≦V24 (NO at S22), then the program proceeds to step S25.

Step S23: The circumferential speed V is set to V23 and the rotation time tr is set to tr23.

Step S24: A check is made to determine whether the rotation time tr23 is reached. If YES, the fixing motor 213 is stopped.

Step S25: The circumferential speed V is set to V24 and the rotation time tr is set to tr24.

Step S26: A check is made to determine whether the rotation time tr24 is reached. If YES, the fixing motor 213 is stopped. Then, the program waits for the next print command.

Table 1 lists circumferential speeds V, corresponding fixing temperatures T, and corresponding rotation times tr.

TABLE 1

| Circumferential speed V mm/sec | Fixing temp. T ° C. | Cooling time tr sec |
|---|---|---|
| V21 = 180 | T21 = 190 | tr21 = 15 |
| V22 = 155 | T22 = 185 | tr22 = 12 |
| V23 = 120 | T23 = 177 | tr23 = 10 |
| V24 = 95 | T24 = 170 | tr24 = 7 |

Figure 8:
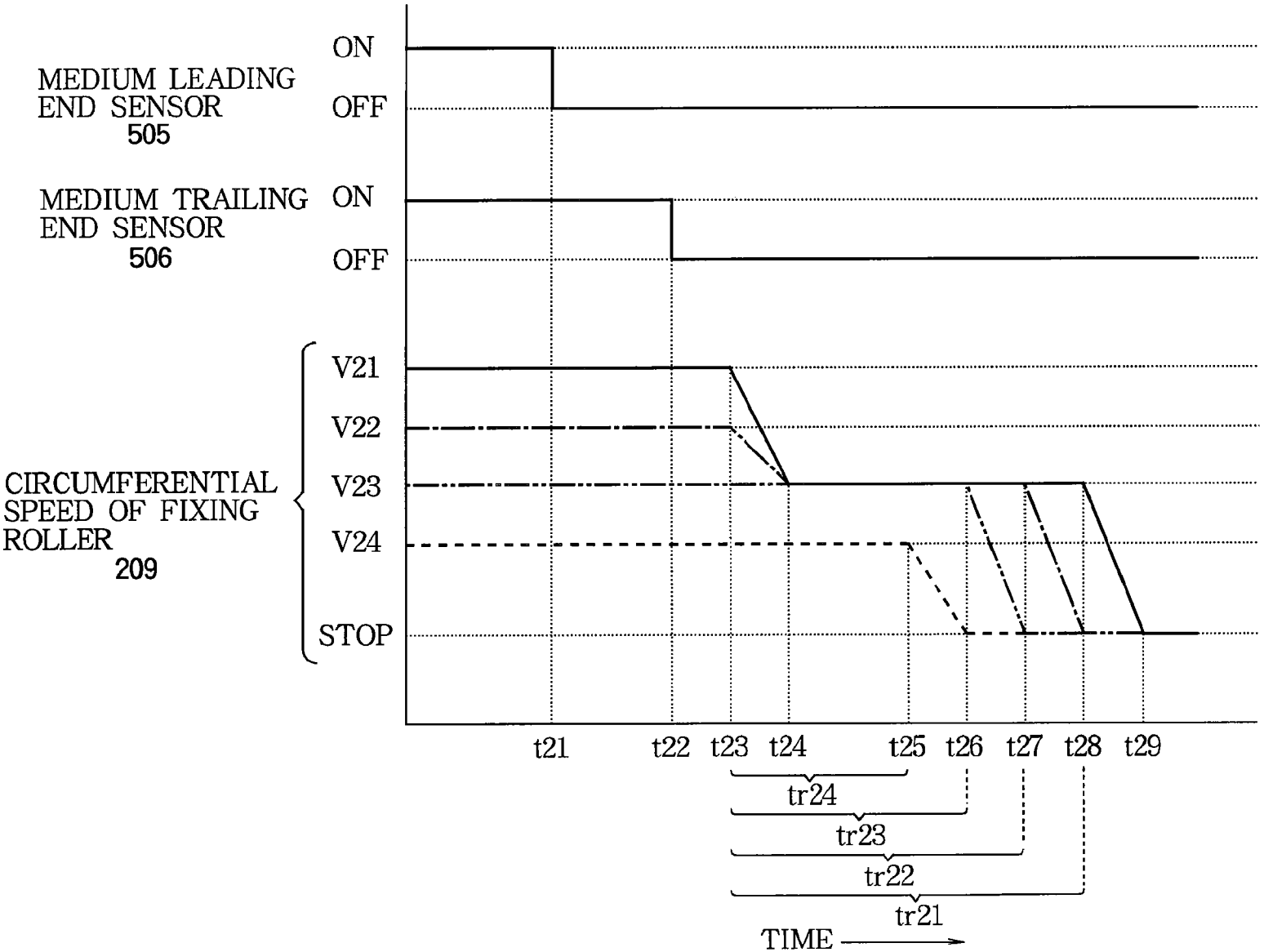
FIG. 8 illustrates a timing chart in accordance with the flowchart of FIG. 7.

FIG. 8 illustrates a timing chart in accordance with the flowchart of FIG. 7.

Referring to FIG. 8, the output of the medium leading end sensor 505 becomes OFF at time t21 and the output of the medium trailing end sensor 506 becomes OFF at time t22. At time t22, the printing controller 800 determines that no recording medium stays in the discharging unit 105. The printing controller 800 sets the circumferential speed V and rotation time tr at time t23 (steps S16, 17, 19, 20, 22, 23, 25). If the circumferential speed V is V21 higher than V23, the circumferential speed V reaches V23 at time t24 and speed reduction completes. Then, the electric power to the fixing motor 213 is shut off at time t28 so that the fixing motor 213 comes to a stop at time t29. Likewise, if the circumferential speed V is V22 higher than V23, the circumferential speed V reaches V23 at time t24 and speed reduction completes. Then, the electric power to the fixing motor 213 is shut off at time t27 so that the fixing motor 213 comes to a stop at time t28. If the circumferential speed V is V23, the fixing motor remains rotating at V23, and the electric power to the fixing motor 213 is shut off at time t26 so that the fixing motor 213 comes to a stop at time t27. If the circumferential speed V is V24, the fixing motor 213 remains rotating at V24, and the electric power to the fixing motor 213 is shut off at time t25 so that the fixing motor 213 comes to a stop at time t26.

The time (t23 to t24) required for reducing the speed of the fixing motor 213 and the times (t28 to t29), (t27 to t28), (t26 to t27), and (t25 to t26) required for stopping the fixing motor 213 are approximately 0.2 seconds. The rotation time tr21 (i.e., t23 to t28) is 15 seconds. The rotation time tr22 (i.e., t23 to t27) is 12 seconds. The rotation time tr23 (i.e., t23 to t26) is 10 seconds. The rotation time tr24 (i.e., t23 to t25) is 7 seconds.

As is clear from FIGS. 7 and 8, the fixing temperatures T21-T24 where T21>T22>T23>T24 are set in correspondence with the circumferential speeds V21-V24 where V21>V22>V23>V24. When it is determined that no recording medium is remaining in the discharging unit 105, if the circumferential speed V is higher than V23, the circumferential speed V is set to V23. The fixing motor 213 remains rotating for the rotation time tr. If the circumferential speed V24 is lower than V23, the circumferential speed remains unchanged and the fixing motor 213 continues to rotate for one of the rotation times tr21-tr24 where tr21>tr22>tr23>tr24 that correspond to V21-V24, respectively. The higher the fixing temperature T and the higher the circumferential speed V, the larger the reduction in speed and the longer the rotation time tr.

In the second embodiment, the fixing temperature and circumferential speed are in a linear relation. However, the fixing temperature and printing speed may not be in a linear relation. For example, the rotation time may be changed in accordance with a selected circumferential speed.

In the second embodiment, the fixing motor 213 is rotated at a speed for maintaining a predetermined printing speed when the recording medium is passing through the fixing unit 104. After the recording medium has been discharged from the fixing unit 104, the fixing motor 213 is rotated such that the circumferential speed is decreased stepwise in accordance with the circumferential speed and fixing temperature during fixing. Therefore, not only the noise level of the image forming apparatus is reduced by decreasing the motor but also the time for the fixing motor to rotate may be shortened, providing a comfortable working environment to the users.

Third Embodiment

Figure 9:
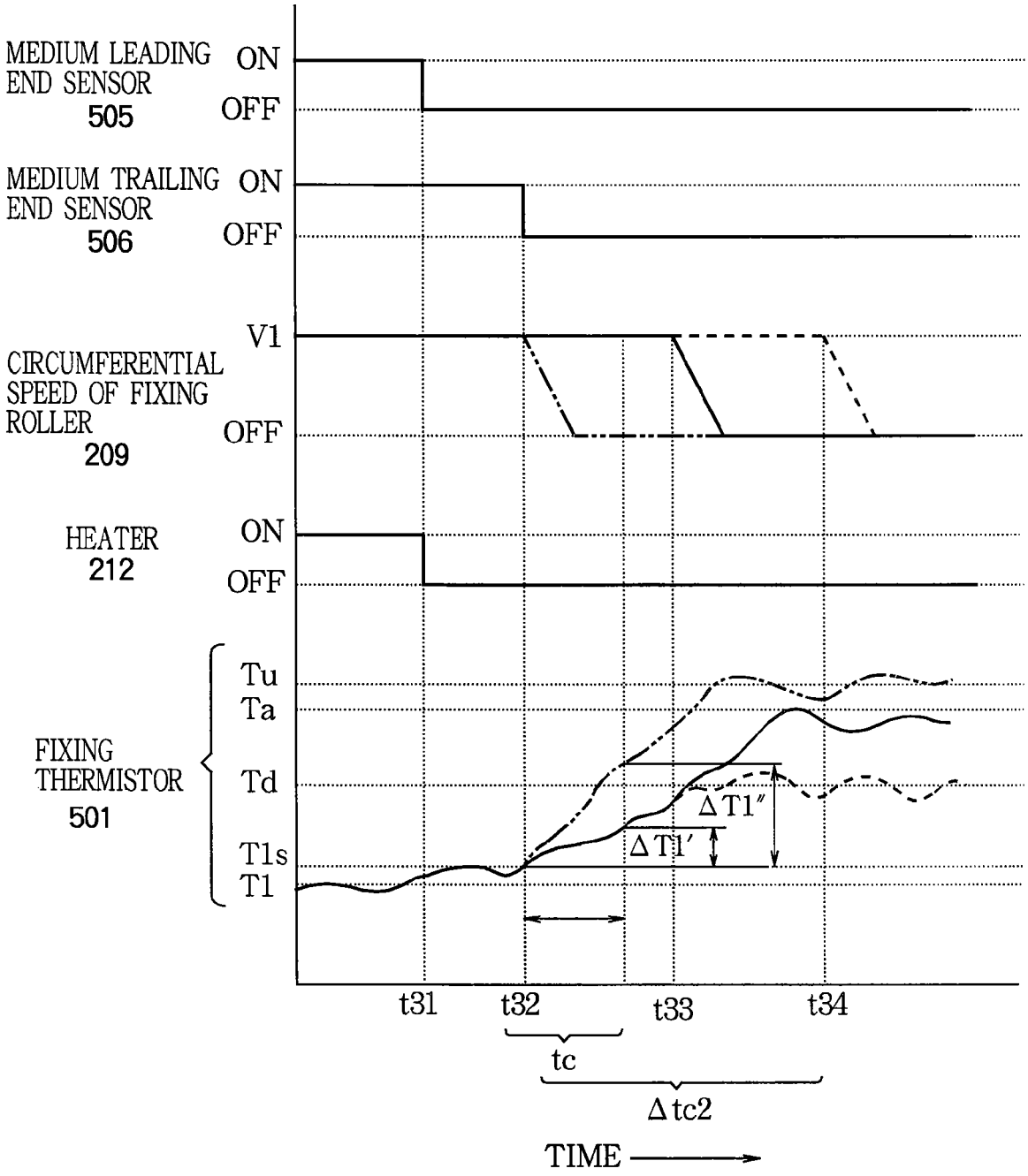
FIG. 9 illustrates the operations of a medium leading end sensor, a medium trailing end sensor, a fixing motor, a heater, and a thermistor in relation with the rotation time.

FIG. 9 illustrates the operations of a medium leading end sensor 505, a medium trailing end sensor 506, a fixing motor 213, a heater 212, and a fixing thermistor 501 in relation with the rotation time tr. If a fixing roller 209 stops rotating at time t32 shortly after the recording medium is discharged from a fixing unit 104, the temperature detected by the fixing thermistor 501 increases as shown in a do-dot line reaching a maximum temperature Tu higher than an abnormal temperature Ta. Conversely, if the fixing roller 209 continues to rotate till time t34 after the recording medium is discharged from a fixing unit 104, the temperature detected by the fixing thermistor 501 reaches a maximum temperature Td as shown in a doted line, and then decreases. If the rotation time Δtc2 is very long, the user is exposed to annoying noise for a long time. Thus, in the third embodiment, the fixing roller is left to cool down for a certain amount of time tc, and then a maximum possible temperature is predicted based on the detected temperature (e.g., ΔT1', ΔT1") after time tc. Then, the rotation time tr is set such that the maximum possible temperature may be lower than the abnormal temperature Ta.

Figure 10:
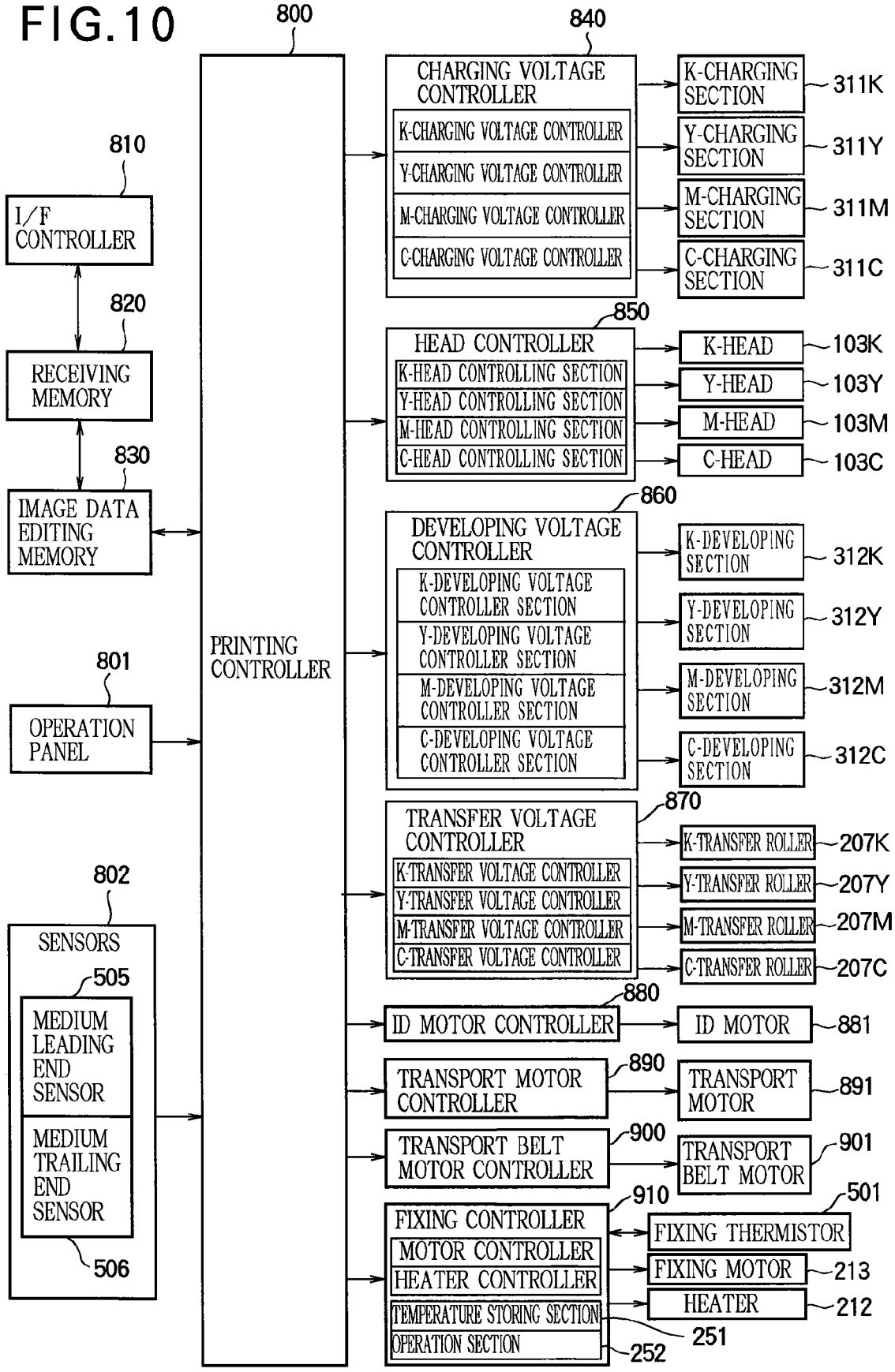
FIG. 10 is a block diagram illustrating a pertinent portion of the control system for an image forming apparatus of a third embodiment.

FIG. 10 is a block diagram illustrating a pertinent portion of the control system for an image forming apparatus of a third embodiment.

The image forming apparatus of the third embodiment differs from that of the first embodiment in that a fixing controller 910 includes a temperature storing section 251 and an operation section 252, and therefore in that the operation of the image forming apparatus involves the operation related to the temperature storing section 251 and the operation section 252. Elements similar to those of the first embodiment have been given the same reference numerals and the description thereof is omitted.

The pertinent portion of the image forming apparatus is the same as that of the first embodiment. Thus, a description will be given with reference to FIG. 1.

Referring to FIG. 10, a printing controller 800 receives control commands and print data from a host apparatus through an I/F controller 810. Upon receiving a print command, the printing controller 800 determines the circumferential speed V of the fixing roller 209 and fixing temperature T based on the received print information. The fixing controller includes the temperature storing section 251 and the operation section 252. The temperature storing section 251 stores temperature information according to fixing temperatures (T21-T24) which is set according to the type of recording medium.

Figure 11:
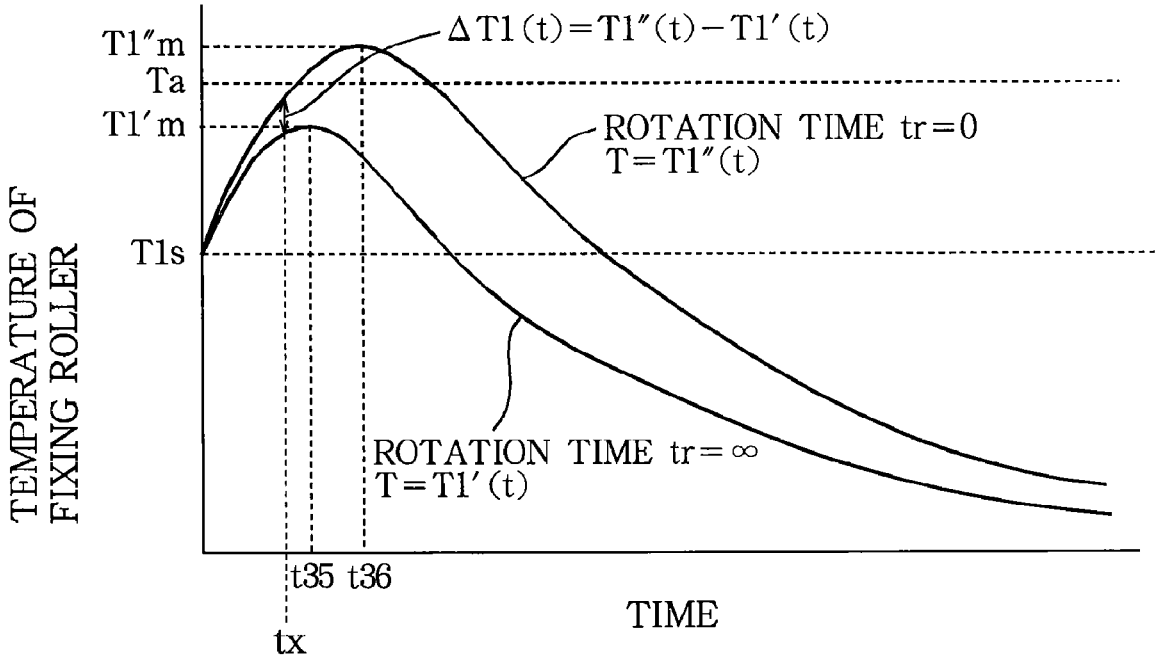
FIG. 11 illustrates temperature profiles stored in a temperature storing section of a fixing controller.

FIG. 11 illustrates temperature profiles stored in the temperature storing section 251 (FIG. 10) of a fixing controller 910, the temperature profiles representing temperature changes of the fixing roller 209 after the recording medium has passed the fixing unit 104.

A profile T=T1' (t) illustrates a temperature of the fixing roller 209 at time t elapsed after the electric power to the heater is shut off while the fixing roller 209 continues to rotate The temperature reaches a highest value T1'm at time t35 and then decreases.

A profile T=T1" (t) illustrates a temperature of the fixing roller 209 at time t elapsed after the electric power to the heater and the fixing roller 209 are shut off. The temperature reaches a maximum T1"m at time t36, and then decreases slowly.

As is clear from the profile T=T1" (t), T1"m exceeds the abnormal temperature Ta. This implies that the fixing motor 213 should rotate for an amount of time for cooling the fixing roller 209. If the fixing motor 213 is rotated for an amount of time, the temperature profile of the fixing roller Tr(t) at time t is given as follows:

$$T1''(t) \leqq Tr(t) \leqq T1''(t)$$

Assume that ΔT1 (t) is the difference between T1" (t) and T1' (t) i.e., ΔT1 (t)=T1" (t)−T1' (t). The temperature profiles T1" (t) and T1' (t) are characteristics when the image forming apparatus is operated in an environment of 40° C., which is a maximum environmental temperature above which the image forming apparatus is not guaranteed to operate normally. Temperature data was obtained at the time of manufacture by detecting the temperature of the fixing roller 209 with time for various rotation times when the printer is operated at a maximum environmental temperature. Then, the temperature data was plotted in the form of a graph of fixing time versus rotation time. The profiles were approximated by a polynomial based on the plotted temperature data.

A description will be given of a temperature profile Tr' (t) where the fixing motor 213 is rotated only for an amount of time tx immediately after the recording medium has passed the fixing unit 104. It is assumed that the image forming apparatus operates in an environment of 40° C.

Figure 12:
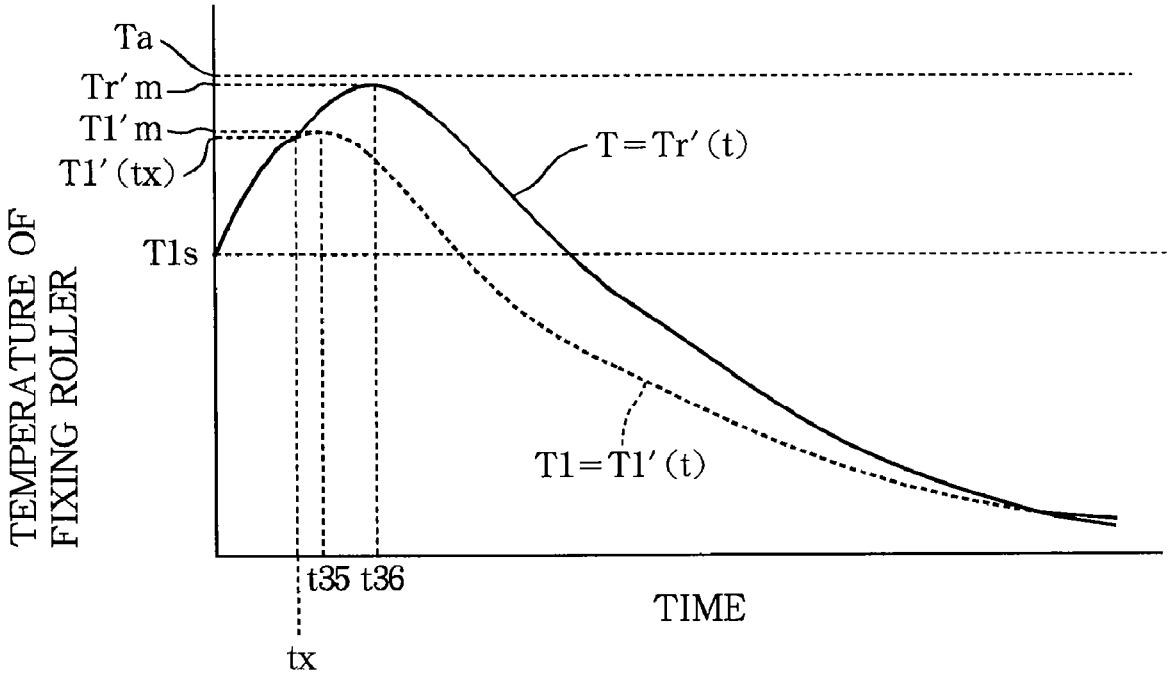
FIG. 12 illustrates temperature profiles when the fixing motor is rotated.

FIG. 12 illustrates temperature profiles when the fixing motor 213 is rotated. As is clear from FIG. 12, the temperature profile Tr' (t) follows the temperature profile T1' (t) until time tx. After time tx, the temperature profile Tr' (t) describes a curve similar to that of T" (t) of FIG. 11. In other words, the temperature profile Tr' (t) follows a curve given by T" (t) of FIG. 11 displaced downwardly by ΔT1 (t).

Thus, a maximum temperature Tr'm is given by the following equation.

$$\begin{aligned} Tr'm &= T''(t36) - \Delta T1(tx) \\ &= T''(t36) - \{T''(tx) - T'(tx)\} \end{aligned} \tag{1}$$

For an environment of a temperature below a maximum allowable temperature (i.e., 40° C.), Trm is given as follows:

$$\begin{aligned} Trm &= \{T1s + T1''(t36) - T1\} - \{T1''(tx) - T1'(tx)\} \\ &= \{T1''(t36) + \Delta T1s\} - \Delta T1(tx) \\ \Delta T1s &= T1s - T1 \end{aligned}$$

where Trm is a maximum temperature, T1*m* is the temperature of the fixing roller after the recording medium has passes the fixing unit 104, and T1 is the temperature of the fixing roller 209 when the temperature data was obtained at the time of manufacture.

In order for Trm not to reach the abnormal temperature Ta, the following relation must be satisfied.

$$Trm = \{T1''(t36) + \Delta T1s\} - \Delta T1(tx) < Ta \quad \Delta T1(tx) > \{T1''(t36) + \Delta T1s\} - Ta \tag{2}$$

providing that 0≦tx≦t36

Based on the temperature information stored in the temperature storing section 251, the operation section 252 computes a shortest rotation time tx that satisfies Equation (2).

In the third embodiment, for a recording medium of a grammage of 70 g/m$^2$, appropriate printing conditions are set as follows:

An appropriate circumferential speed (corresponding to printing speed) may be selected from among V31=180 mm/sec, V32=155 mm/sec, V33=120 mm/sec, and V34=95 mm/sec.

An appropriate fixing temperature T may be selected from among T31=190° C., T32=185° C., T33=177° C., and T34=170° C.

The temperature T1*s* detected by the fixing thermistor 501 after the recording medium has passed the fixing unit 104 is 193° C.

Figure 13:
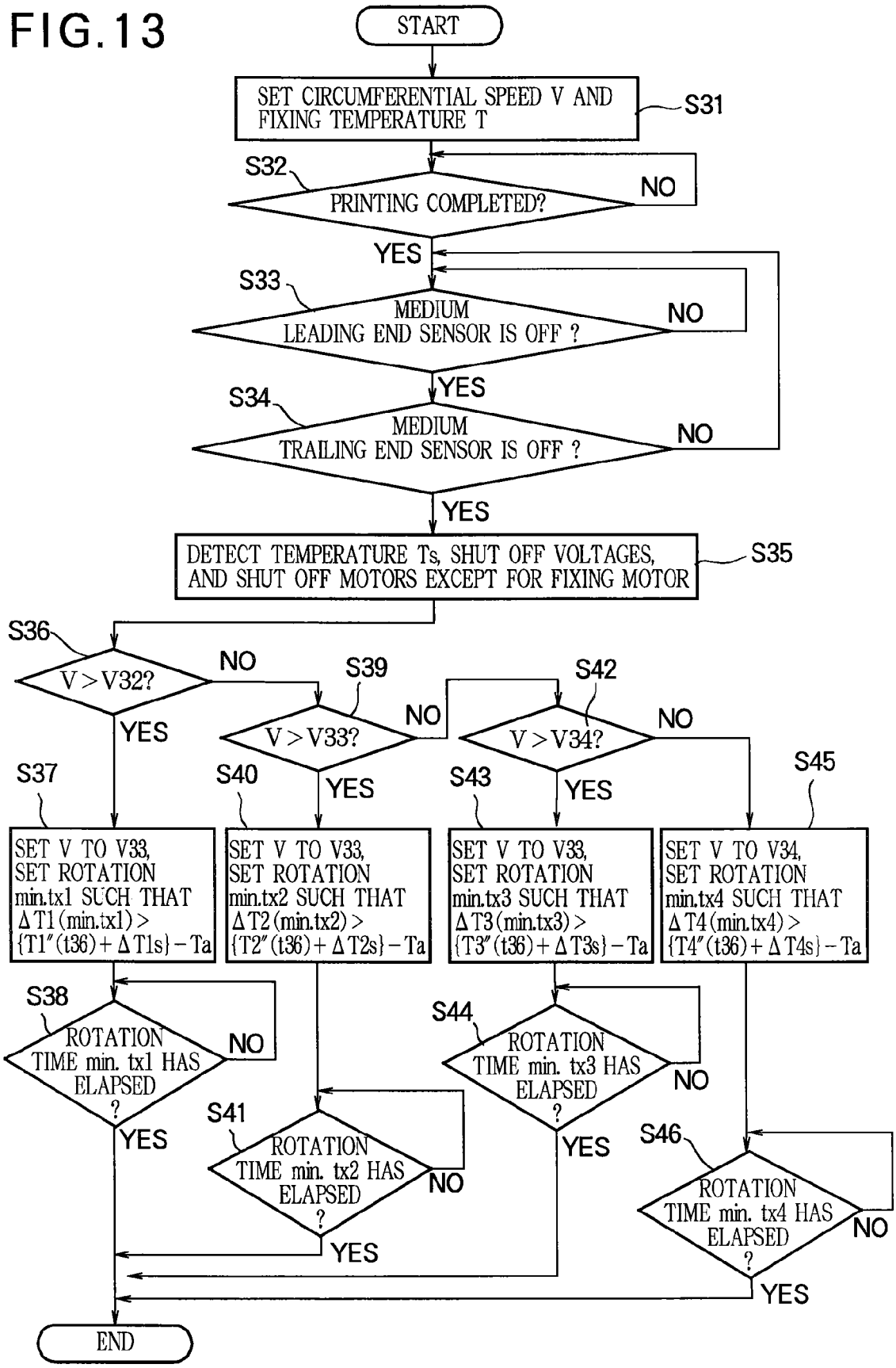
FIG. 13 illustrates the operation of the image forming apparatus of the third embodiment.

FIG. 13 illustrates the operation of the image forming apparatus of the third embodiment. The operation of the image forming apparatus of the aforementioned configuration will be described with reference to FIG. 13.

Step S31: The printing controller 800 receives the control commands and print data from the host apparatus via the I/F controller 810. Upon receiving a print command from the host apparatus, the printing controller 800 checks the received print information to detect the circumferential speed V and the fixing temperature T. The circumferential speed V is selected from among V31=180 mm/sec, V32=155 mm/sec, V33=120 mm/sec, and V34=95 mm/sec. The fixing temperature T is selected from among T31, T32, T33, and T34. The four different values of the circumferential speed V and four different values of the fixing temperature T are available for paper of a grammage of 70 g/m$^2$, depending on the environment in which the apparatus operates, and are listed in a table stored in a memory of the printing controller 800.

After printing conditions are set at S31, printing is performed after until all of the pages have been printed out at S32. This printing is performed in the exactly the same manner as step S1 of FIG. 4 and the description thereof is omitted.

Step S32: A check is made to determine whether printing has been completed. If printing has not been completed, printing is continued at the selected circumferential speed V and the fixing temperature until all of the pages have been printed out.

Step S33 and S34: A check is made based on the outputs of the medium leading end sensor 505 and the medium trailing end sensor 506 to determine whether the recording medium remains within the discharging unit 105.

Step S35: Once it is determined that all of the pages of medium have been discharged from the fixing unit 104, the voltages applied to the charging section 311K, 311Y, 311M, and 311C, developing sections 312K, 312Y, 312M, and 312C, transfer rollers 207K, 207Y, 207M, and 207C, and heater 212 are shut off. Also, the motors except for the fixing motor 213 are shut off. The fixing thermistor 501 detects the temperature Ts of the fixing roller 209 immediately after the recording medium has been discharged from the fixing unit 104.

The medium leading end sensor 505 and medium trailing end sensor 506 continue to generate detection signals (i.e., ON state) when the recording medium is passing by these sensors. Therefore, when the trailing end of the recording medium has advanced past the medium trailing end sensor 506, it is determined that no recording medium is remaining in the discharging unit 105.

Step S36: A check is made to determine whether the circumferential speed V is greater than V32. If YES, the program proceeds to step S37. If NO, the program proceeds to S39.

Step S37: The printing controller 800 sets the circumferential speed V to V33, and reads T1' (t), T1" (t), T1" (t36) and Ta from the temperature storing section 251. The operation section 252 computes a shortest rotation time tr=min.tx1 such that $\Delta T1\ (\min.tx1) > \{T1''\ (t36) + \Delta T1s\} - Ta$. This shortest rotation time tr=min.tx1 is set to the rotation time tr for which the fixing motor 213 is rotated for cooling.

Step S38: A check is made to determine whether the rotation time tr=min.tx1 expires. If YES, the program ends.

Step S39: If V≦V32 (NO at step S36), a check is made to determine whether the circumferential speed V is greater than V33. If YES, the program proceeds to step S40. If NO, the program proceeds to step S42.

Step S40: The printing controller 800 sets the circumferential speed V to V33, and reads T2' (t), T2" (t), T2" (t36) and Ta from the temperature storing section 251- The operation section 252 computes a shortest rotation time tr=min.tx2 such that $\Delta T2(\min.tx2) > \{T2''\ (t36) + \Delta T2s\} - Ta$. This shortest rotation time tr=min.tx2 is set to the rotation time tr for which the fixing motor 213 is rotated for cooling the fixing roller 209.

Step S41: A check is made to determine whether the rotation time tr=min.tx2 expires. If YES, the program ends.

Step S42: If V≦V33 (NO at step S39), a check is made to determine whether the circumferential speed V is greater than V34. If YES, the program proceeds to step S43. If NO, the program proceeds to step S45.

Step S43: The printing controller 800 sets the circumferential speed V to V33, and reads T3' (t), T3" (t), T3" (t36) and Ta from the temperature storing section 251. The operation section 252 computes a shortest rotation time tr=min.tx3 such that $\Delta T3(\min.tx3) > \{T3''\ (t36) + \Delta T3s\} - Ta$. This shortest rotation time tr=min.tx3 is set to the rotation time tr for which the fixing motor 213 is rotated for cooling.

Step S44: A check is made to determine whether the rotation time tr=min.tx3 expires. If YES, the program ends.

Step S45: The printing controller 800 sets the circumferential speed V to V34, and reads T4' (t), T4" (t), T4" (t36), and Ta from the temperature storing section 251. The operation section 252 computes a shortest rotation time tr=min.tx4 such that $\Delta T4(\min.tx4) > \{T4''\ (t36) + \Delta T4s\} - Ta$. This shortest rotation time tr=min.tx3 is set to the rotation time tr for which the fixing motor 213 is rotated for cooling.

Step S46: A check is made to determine whether the rotation time tr=min.tx4 expires. If YES, the program ends.

Table 2 lists circumferential speeds V and corresponding fixing temperatures and rotation times tx, which are set at step S31. The rotation times min.tx1 to min.tx4 are selectively set at steps after step S36.

TABLE 2

| Circumferential speed V mm/sec | Fixing temp. T ° C. | Cooling time tr sec |
|---|---|---|
| V31 = 180 | T31 = 190 | min. tx1 = 15 |
| V32 = 155 | T32 = 185 | min. tx2 = 12 |
| V33 = 120 | T33 = 177 | min. tx3 = 10 |
| V34 = 95 | T34 = 170 | min. tx4 = 7 |

As is clear from the flowchart in FIG. 13, the fixing temperatures T31-T34 (T31>T32>T33>T34) and corresponding printing speeds V31-V34 (V31>V32>V33>V34) are set. Additionally, shortest rotation times min.tx1-min.tx4 necessary for the temperature of the fixing roller not to exceed the abnormal temperature Ta are determined and set.

The third embodiment has been described in terms of a method of computing the rotation time tr. The invention is not limited to this method. For example, the relation for computing the rotation times for various fixing temperatures may be derived by experiment for setting the rotation time tr.

Just as in the first embodiment, after the recording medium has passed the fixing unit 104, the fixing motor is rotated at a speed lower that during fixing. Then, a shortest rotation time is computed according to the circumferential speed during fixing and fixing temperature such that the temperature of the fixing roller will not reach an abnormal temperature after the recording medium has left the fixing unit. This configuration not only minimizes noise generated after the recording medium has left the fixing unit but also shortens the rotation time of the fixing motor, providing a quiet working environment to the user.

Fourth Embodiment

Figure 14:
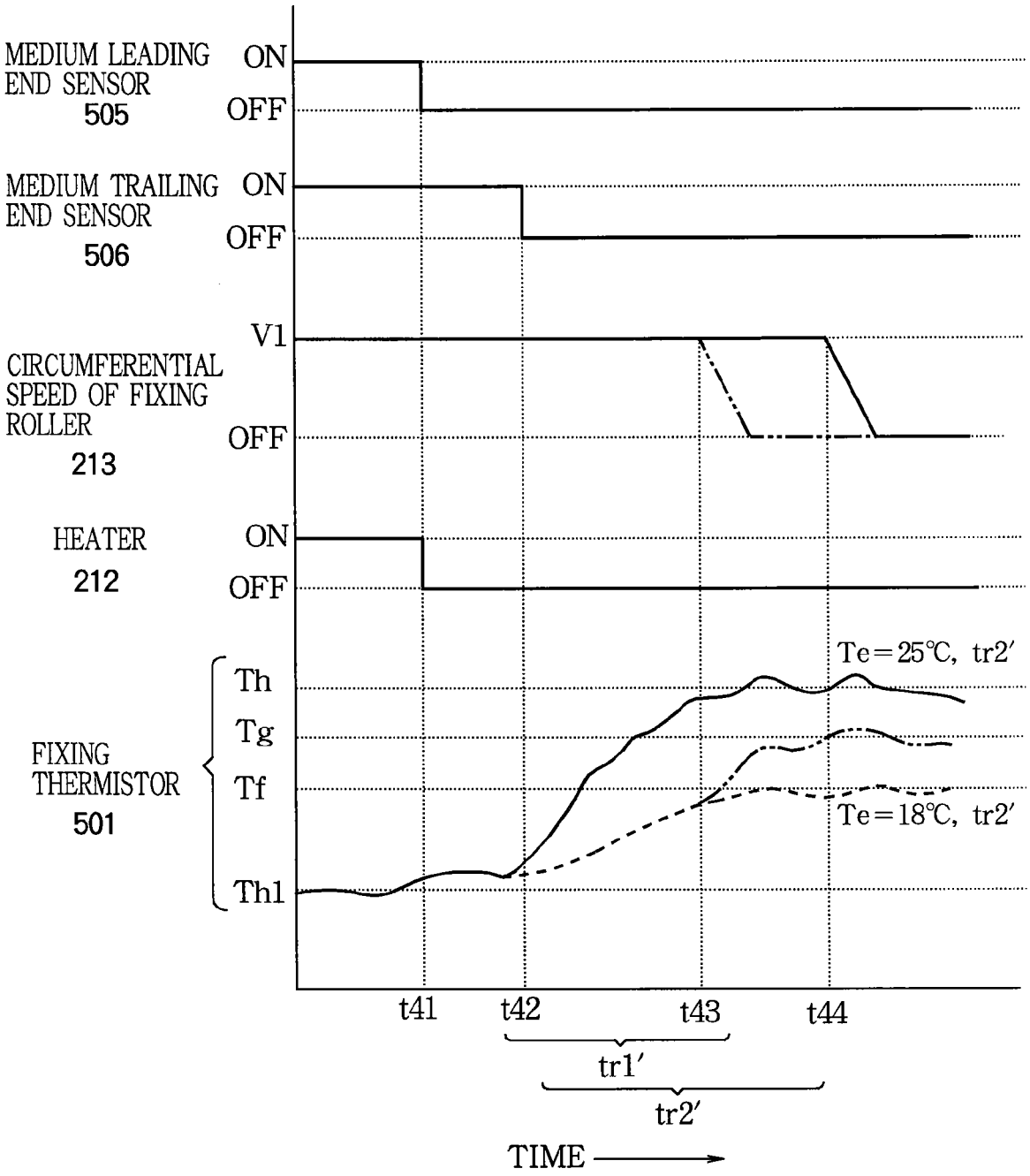
FIG. 14 is a graph illustrating the effects of the environment on the fixing roller after the recording medium has left the fixing unit.

FIG. 14 is a graph of experimental results illustrating the effects of the environment on the fixing roller 209 after the recording medium has left the fixing unit 104. With the circumferential speed V=190 mm/sec, fixing temperature T=190° C, and rotation time tr=15 sec, overshoot caused a maximum temperature of the fixing roller Th to increase to Th=220° C. when the environment temperature was 25° C., and to Th=215° C. when the environment temperature was 18° C. In other words, the efficiency for cooling the fixing roller varies depending on the environmental temperature, and consequently, the overshoot of the temperature of the fixing roller 209 varies greatly. Thus, a fourth embodiment employs a means for detecting an environmental temperature, and efficiently sets the rotation time tr in accordance with the environmental temperature.

Figure 15:
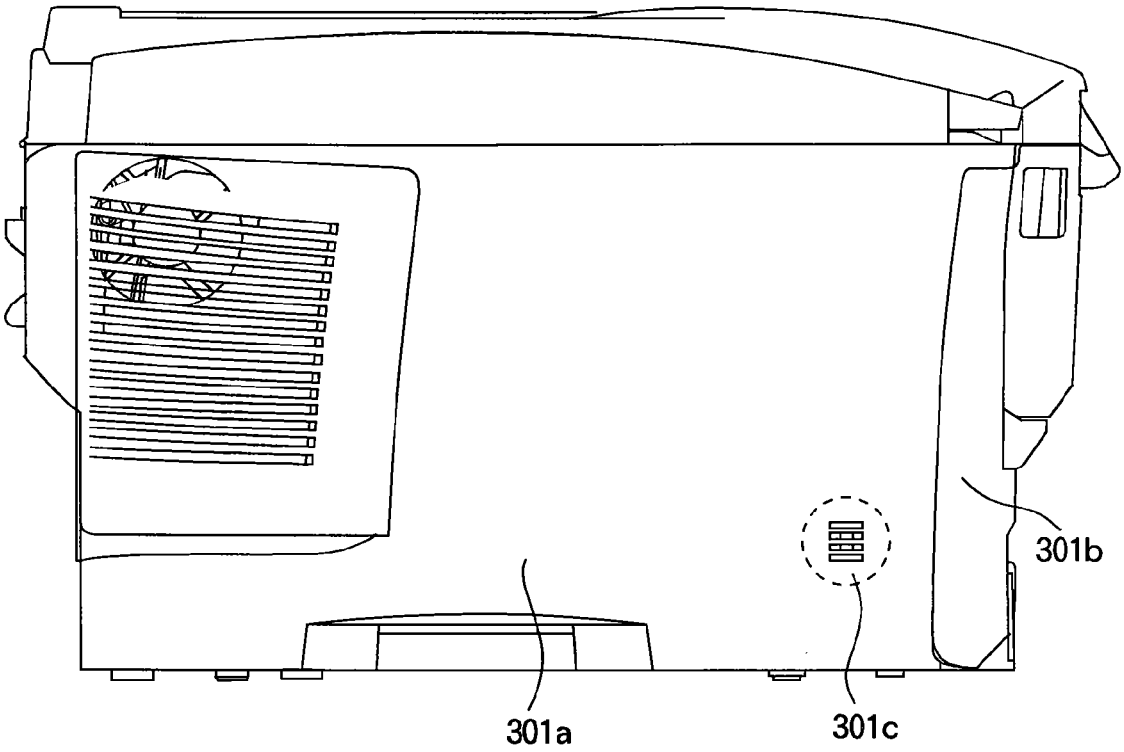
FIG. 15 is a front view of an image forming apparatus of a fourth embodiment.
Figure 16:
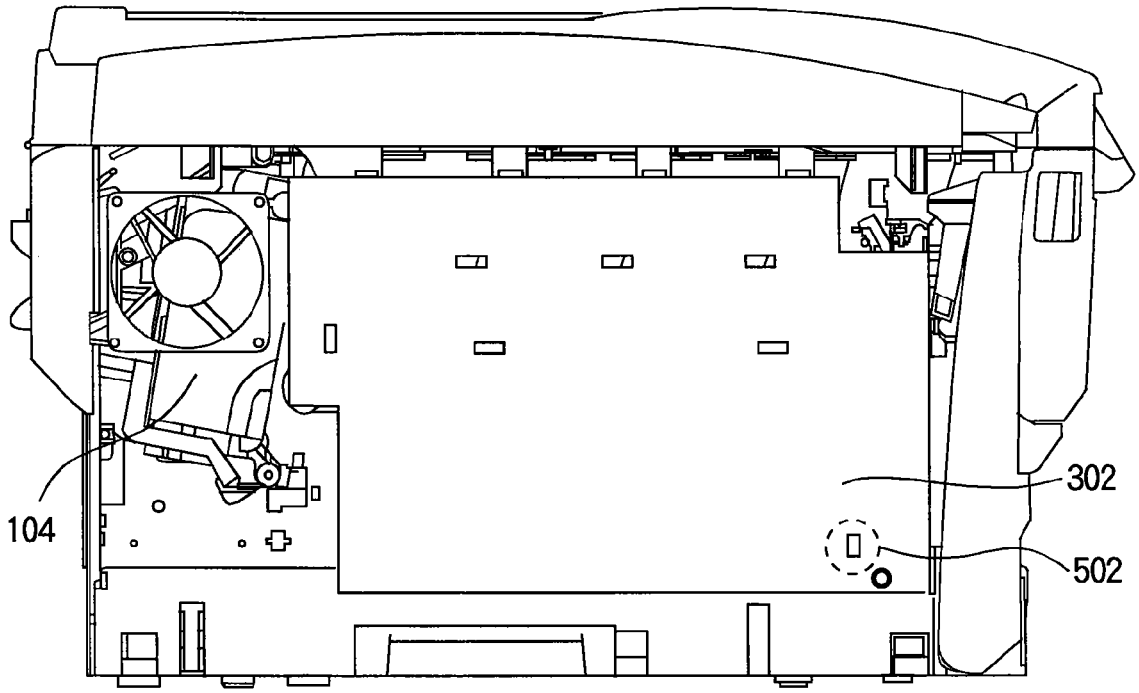
FIG. 16 is a front view of the image forming apparatus when an outer housing wall is dismounted from the apparatus.
Figure 17:
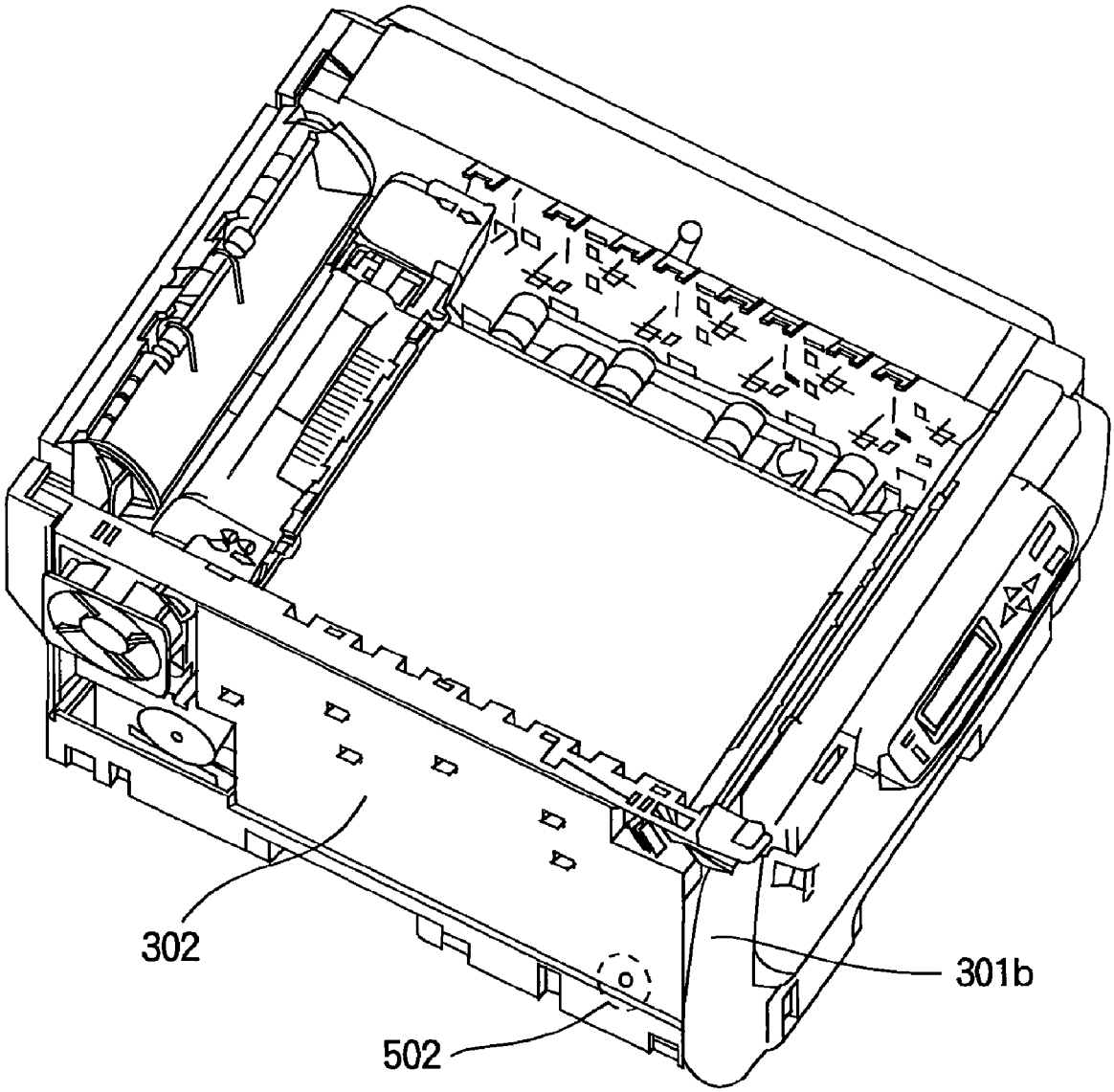
FIG. 17 is a perspective view of the image forming apparatus shown in FIG. 16.

FIGS. 15-18 illustrate a pertinent portion of an image forming apparatus of the fourth embodiment. FIG. 15 is a front view of the image forming apparatus. FIG. 16 is a front view of the image forming apparatus when an outer housing wall 301*a* is dismounted from the apparatus. FIG. 17 is a perspective view of the image forming apparatus shown in FIG. 16.

Figure 18:
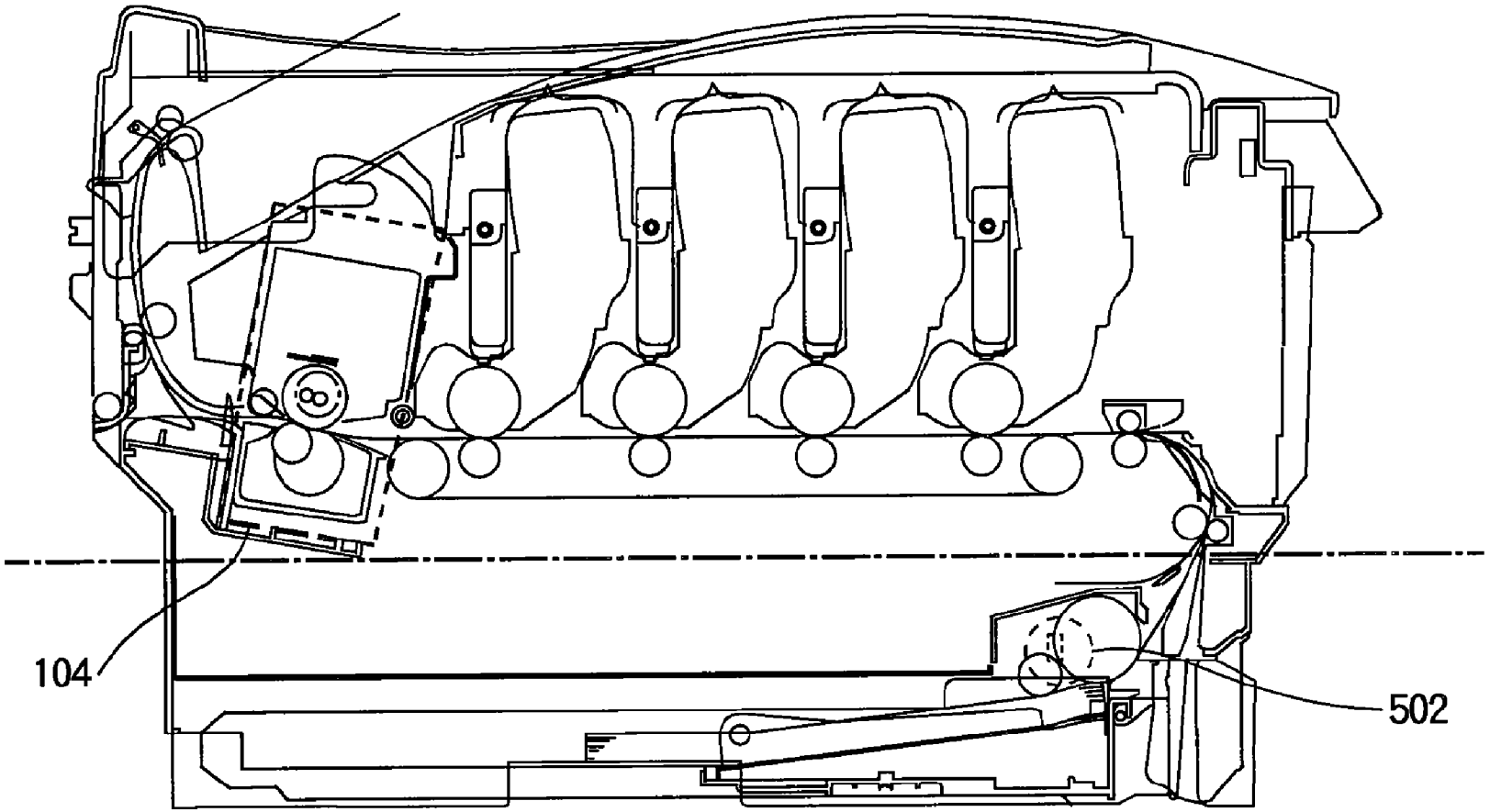
FIG. 18 illustrates a general configuration of a pertinent portion of the interior of the image forming apparatus.

FIG. 18 illustrates a general configuration of a pertinent portion of the interior of the image forming apparatus.

Referring to FIGS. 15-17, the outer housing wall 301*a* has an air hole 301*c* formed therein. A environment thermistor 502 is mounted on a printed circuit board 302 disposed at the far end of the hole 301*a*, and is used to detect an environmental temperature. The printed circuit board 302 produces a high voltage to be applied to a transfer roller 207 (FIG. 1). For accurate detection of the environmental temperature, the environment thermistor 502 is located close to the outer housing walls 301*a* and 301*b*, under the fixing unit 104, and near the front end of the image forming apparatus away from the fixing unit 104. The environment thermistor 502 is below the fixing unit 104 in the gravitational direction. As described above, the fourth embodiment differs from the first embodiment in the mechanical configuration, i.e., the environment thermistor 502 is added.

Figure 19:
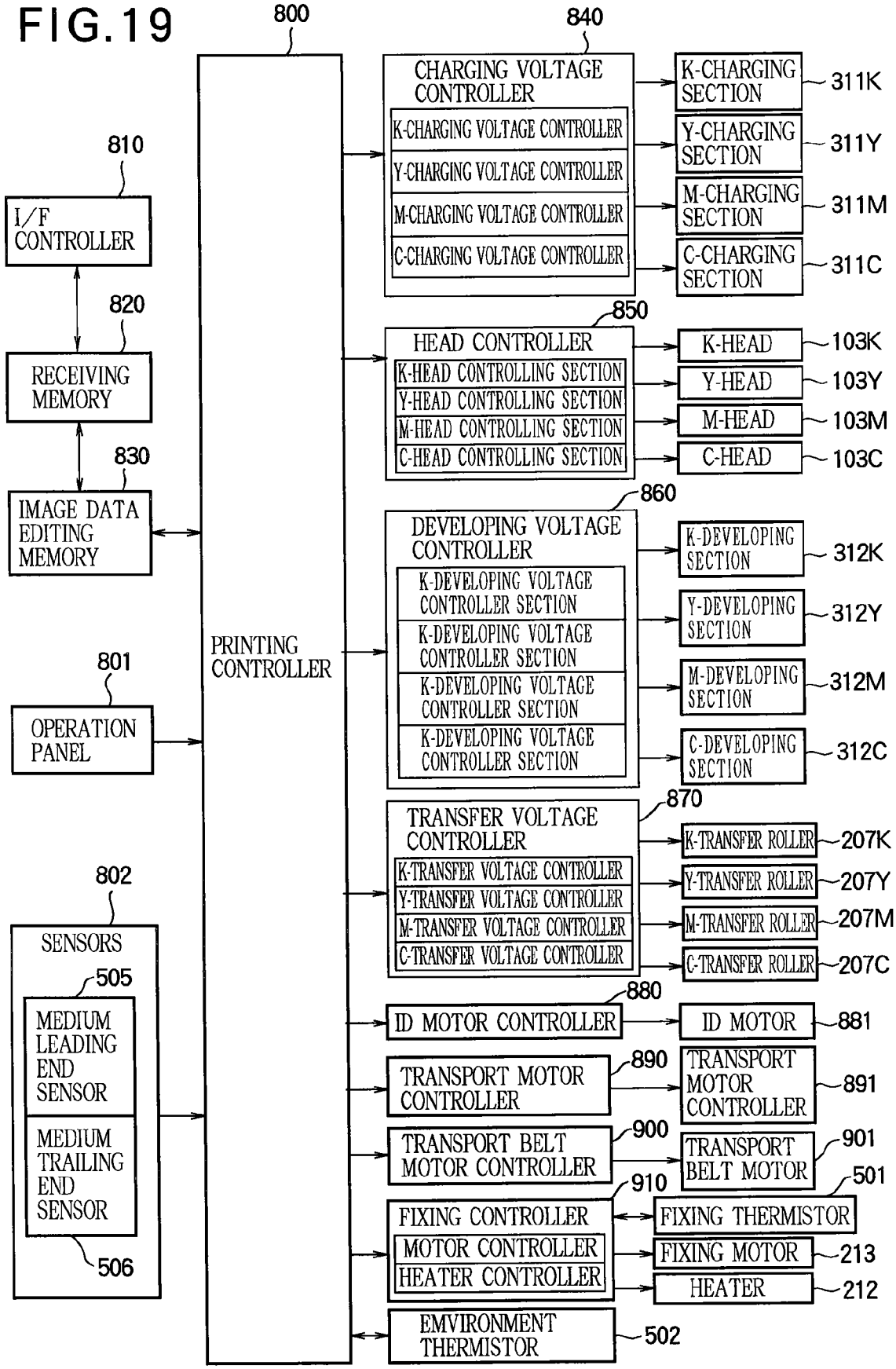
FIG. 19 is a block diagram illustrating a pertinent portion of a control system of the image forming apparatus of the fourth embodiment.

FIG. 19 is a block diagram illustrating a pertinent portion of a control system of the image forming apparatus of the fourth embodiment. The control system of the fourth embodiment differs from that of the first embodiment in that the environment thermistor 502 is added and the operation involves the environment thermistor 502. Elements similar to those of the first embodiment have been given the same reference numerals and the description thereof is omitted.

Referring to FIG. 19, the printing controller 800 receives control command sand print data from a host apparatus via an I/F controller 810. Upon receiving a print command from the host apparatus, the printing controller 800 determines a circumferential speed V of a fixing roller, a fixing temperature T, and a rotation time tr from the received print information.

In the fourth embodiment, for a recording medium of grammage of 70 g/m$^2$, appropriate printing conditions are set as follows:

An appropriate circumferential speed (i.e., printing speed) may be selected from among V41=180 mm/sec, V42=155 mm/sec, V43=120 mm/sec, and V44=95 mm/sec.

An appropriate fixing temperature T may be selected from among T41=190° C., T42=185° C., T43=177° C., and T44=170° C.

Further, a threshold Tb of the environmental temperature Te is provided. If the environmental temperature Te is below the threshold Tb, then the rotation time may be shortened. The threshold Tb is selected to be Tb=20° C. The rotation time tr when the environmental temperature Te is below the threshold Tb may be selected from among tr1*s*=14.5 sec, tr2*s*=11 sec, tr3*s*=8.5 sec, and tr4*s*=5 sec. The rotation time tr when the environmental temperature Te is not lower than the threshold Tb may be selected from among tr41=15 sec, tr42=12 sec, tr43=10 sec, and tr44=7 sec.

Figure 20:
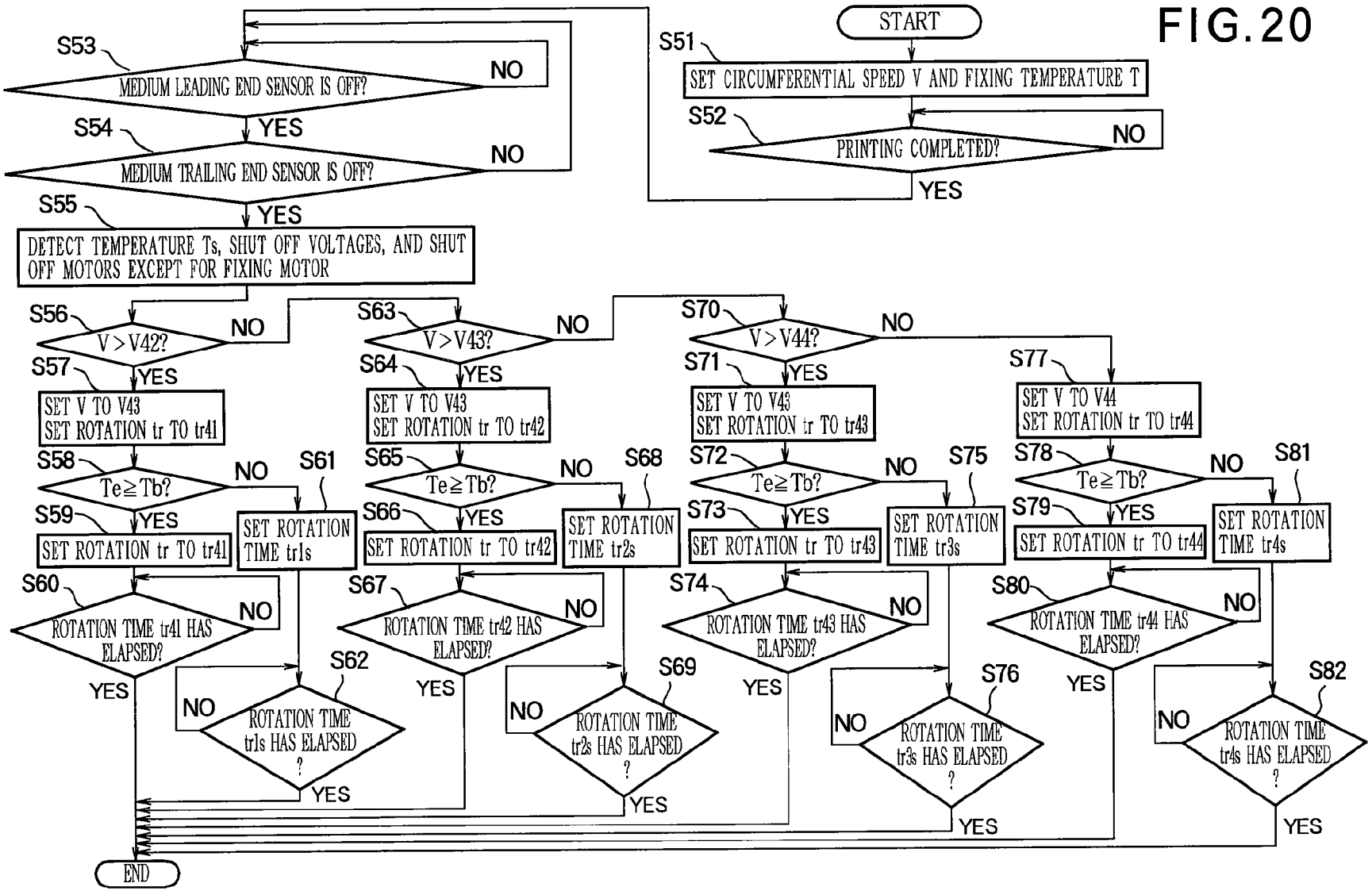
FIG. 20 illustrates the operation of the image forming apparatus of the fourth embodiment.

FIG. 20 illustrates the operation of the image forming apparatus of the fourth embodiment. The operation of the image forming apparatus of the aforementioned configuration will be described with reference to the flowchart in FIG. 20.

Step S51: The printing controller 800 receives the control commands and print data from the host apparatus via the I/F controller 810. Upon receiving a print command from the host apparatus, the printing controller 800 checks the received print information to detect the circumferential speed V, the fixing temperature T, and rotation time tr. Optimum values of circumferential speed V, fixing temperature, and rotation time tr are selected from among V41-V44, T41-T44, and tr41-tr44. The four different values of the circumferential speed V, four different values of the fixing temperature T, rotation times tr41-tr44, and rotation times tr1*s*-tr4*s* are available for paper of grammage of 70 g/m$^2$, depending on the environment in which the apparatus operates, and are listed in a table stored in a memory of the printing controller 800.

After step S51 where the printing conditions are set, normal printing is performed until it is determined at step S52 that printing has been completed. The printing is carried out in exactly the same manner as that after step S1 of FIG. 4, and therefore the description thereof is omitted.

Step S52: A check is made to determine whether printing has been completed. If NO, printing is carried out at the circumferential speed V and the fixing temperature T. If YES, the program proceeds to step S53.

Steps S53-S54: A check is made based on the outputs of the medium leading end sensor 505 and the medium trailing end sensor 506 to determine whether the recording medium remains in the discharging unit 105.

Step S55: If YES at Steps S53 and S54, the high voltages supplied to the charging sections 311K, 311Y, 311M, and 311C, the developing sections 312K, 312Y, 312M, and 312C, the transfer rollers 207K, 207Y, 207M, and 207C, and the electric power supplied to the heater 212 are shut off, and the motors except for the fixing motor 213 are shut off.

The medium leading end sensor 505 and the medium trailing end sensor 506 continue to generate detection signals when the recording medium is passing by these sensors. Therefore, when the trailing end of the recording medium advanced past the medium trailing end sensor 506, it is determined at steps S53-S54 that no recording medium is remaining in the discharging unit 105.

Step S56: A check is made to determine whether the circumferential speed V is higher than a predetermined threshold V42. If V>V42 (YES at S56), then the program proceeds to step S57.

Step S57: The circumferential speed V is set to V43 and the rotation time tr is set to tr41.

Step S58: A check is made to determine whether environmental temperature Te is not lower than the threshold Th. If Te≧Tb (YES at S58), the program proceeds to step S59. If NO (Te<Tb), the program proceeds to step S61. Step S59: The rotation time tr is set to tr41.

Step S60: The fixing motor 213 is rotated for tr=tr41 and is then shut off.

Step S61: The rotation time tr is set to tr=tr1*s*.

Step S62: The fixing motor 213 is rotated for tr=tr1*s* and is then shut off.

Step S63: If the answer is NO (i.e., V≦V42) at step S56, a check is made to determine whether the circumferential speed V is greater than the threshold V43. If YES, the program proceeds to step S64. If NO, the program proceeds to step S70.

Step S64: The circumferential speed V is set to V43 and rotation time tr is set to tr=tr42.

Step S65: A check is made to determine whether the environmental temperature Te is not lower than the threshold Tb. If YES (i.e., Te≧Tb), the program proceeds to step S66. If NO, the program proceeds to step S68.

Step S66: The rotation time tr is set to tr=tr42.

Step S67: The fixing motor 213 is rotated for tr=tr42 and is then shut off.

Step S68: The rotation time tr is set to tr=tr2*s*.

Step S69: The fixing motor 213 is rotated for tr=tr2*s* and is then shut off.

Step S70: If the answer is NO at step S63 (i.e., V≦V43), a check is made to determine whether the circumferential speed V is greater than the threshold V44. If YES, the program proceeds to step S71. If NO, the program proceeds to step S77.

Step S71: The circumferential speed V is set to V43 and rotation time tr is set to tr=tr43.

Step S72: A check is made to determine whether the environmental temperature Te is not lower than the threshold Tb. If YES, the program proceeds to step S73. If NO, the program proceeds to step S75.

Step S73: The rotation time tr is set to tr=tr43.

Step S74: The fixing motor 213 is rotated for tr=tr43 and is then shut off.

Step S75: The rotation time tr is set to tr=tr3*s*.

Step S76: The fixing motor 213 is rotated for tr=tr3*s* and is then shut off.

Step S77: The circumferential speed V is set to V44 and rotation time tr is set to tr=tr44.

Step S78: A check is made to determine whether the environmental temperature Te is not lower than the threshold Tb. If YES, the program proceeds to step S79. If NO, the program proceeds to step S81.

Step S79: The rotation time tr is set to tr=tr44.

Step S80: The fixing motor 213 is rotated for tr=tr44 and is then shut off.

Step S81: The rotation time tr is set to tr=tr4*s*.

Step S82: The fixing motor 213 is rotated for tr=tr4*s* and is then shut off and the program ends.

Table 3 lists circumferential speeds V and corresponding fixing temperatures and rotation times tr41-tr44 and tr1*s*-tr4*s*, which are set at step S51. The rotation times are selected from either tr41-tr44 or tr1*s*-tr4*s* depending on the environmental temperature Te.

TABLE 3

| Circumferential speed V | Fixing temp. T | Cooling time tr | |
|---|---|---|---|
| mm/sec | ° C. | Te ≧ Tb | Te < Tb sec |
| V41 = 180 | T41 = 190 | tr41 | tr1s |
| V42 = 155 | T42 = 185 | tr42 | tr2s |
| V43 = 120 | T43 = 177 | tr43 | tr3s |
| V44 = 95 | T44 = 170 | tr44 | tr4s |

As is clear from the flowchart in FIG. 20, the fixing temperatures T41-T44 (T41>T42>T43>T44) and corresponding printing speeds V41-V44 (V41>V42>V43>V44) and rotation time tr are selectively set. For each combination of the fixing temperature and the circumferential speed, the rotation time tr is selected in accordance with the environmental temperature Te.

In the fourth embodiment, the fixing temperature T, circumferential speed V, and rotation time tr are set at step S51. The rotation time tr is not necessary to be set at step S51 because the rotation time tr is set at a later time. The rotation time is selected from among values in two ranges of environmental temperature. Alternatively, the rotation time may be selected from among values in a plurality of ranges of environmental temperature.

Just as in the first embodiment, the fixing motor is rotated at a lower speed after the recording medium has passed the fixing unit 104 than when the recording medium is passing through the fixing unit 104. Then, the rotation time is increased in small increments according to the circumferential speed during printing, fixing temperature, and environmental temperature such that a shortest possible rotation time is achieved. In this manner, the noise generated after the recording medium has left the fixing unit may be reduced by not only reducing the circumferential speed but also shortening the rotation time of the fixing motor. This provides a quiet working environment to the user.

Fifth Embodiment

Figure 21:
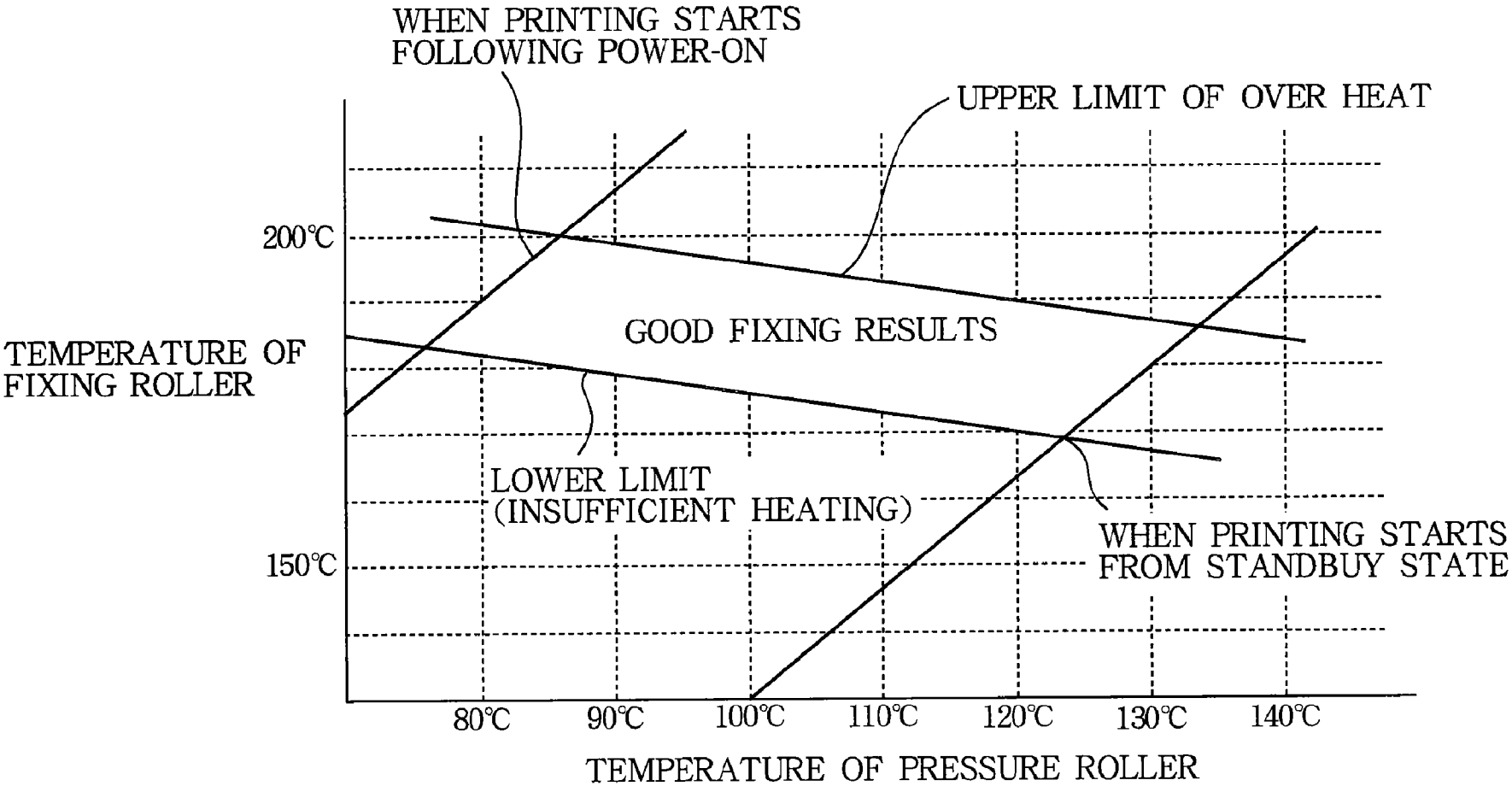
FIG. 21 is a graph of experimental results for determining an optimum range of fixing temperature.

FIG. 21 is a graph of experimental results for determining an optimum range of fixing temperature. A temperature of the fixing roller may have different fixing results depending on the amount of heat transferred to the toner on a recording medium. An excessive amount of heat causes adhesion of toner to a fixing roller to be stronger than agglomeration of toner. As a result, some of the toner melted and fixed into the recording medium is removed from the recording medium, and remains adhering to the fixing roller when the recording medium leaves the fixing roller. Conversely, a low temperature of the fixing roller causes poor fusion of the toner, so that adhesion of toner to the fixing roller is higher than to the recording medium. This causes poor fixing results.

Thus, in order to implement an optimum fixing temperature, the temperature of a pressure roller, which is at a lower temperature than the fixing roller, is detected. Then, the heater is controlled to be ON and OFF in accordance with the temperature of the fixing roller detected by a fixing thermistor 501 while also taking the temperature of the pressure roller into account. This way ensures that good fixing results are obtained over a wide range of fixing temperature and over a wide range of printing speed.

Figure 22:
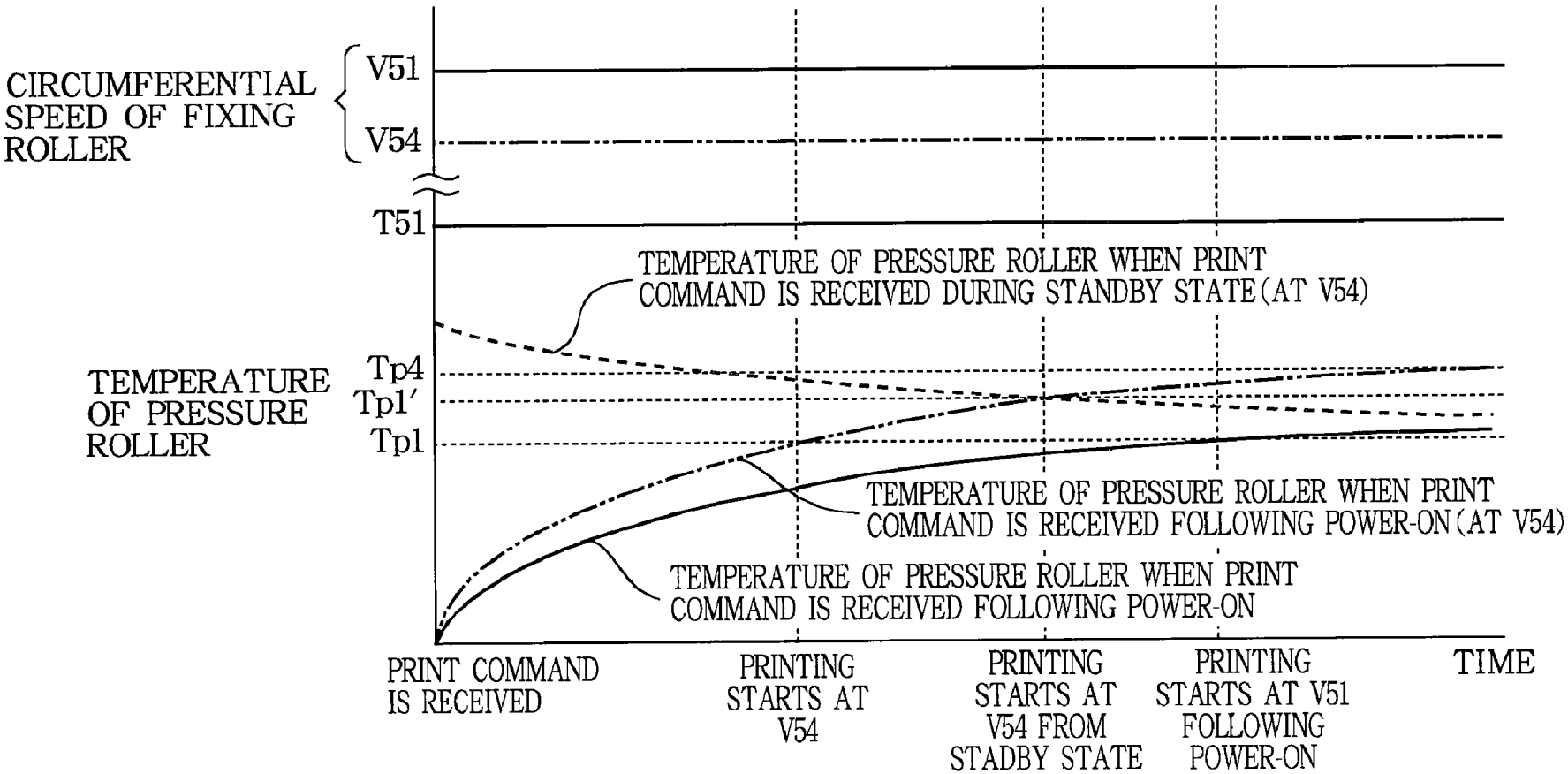
FIG. 22 illustrates the relation between the temperature of the fixing roller and the temperature of the pressure roller when a print command is issued to print at a circumferential speed of a fixing roller.

FIG. 22 illustrates the relation between the temperature of the fixing roller and the temperature of the pressure roller when a print command is issued to print at a circumferential speed V51 of the fixing roller. As is clear from FIG. 22, taking into consideration of the temperature of the pressure roller may accelerate the timing at which printing is started, irrespective of whether printing is started shortly after power on of the printer or from a standby state. In other words, printing may start immediately after the temperature of the fixing roller falls within an optimum temperature range (e.g., Tp1-Tp1').

Conversely, when printing is performed at a fixing temperature T51, if printing is performed at a circumferential speed V54 lower than a circumferential speed V51, the efficiency of heat transfer due to convection to the environment is low even if the fixing temperature is within an optimum range. Therefore, the temperature Tp4 of the pressure roller at the circumferential speed V54 is higher than the temperature Tp1 at the speed V51.

After the recording medium has passed the fixing unit, the fixing roller is rotated for the rotation time tr, so that heat is transferred from the fixing roller at a higher temperature to the pressure roller at a lower temperature. For the same temperature of the fixing roller, the lower the temperature of the pressure roller is, the larger amount of heat is transferred from the fixing roller to the pressure roller. This causes a different amount of overshoot of the temperature of the fixing roller. In a fifth embodiment, the temperature of the pressure roller is detected and the rotation time is set in accordance with the temperature of the pressure roller, thereby setting an efficient rotation time.

Figure 23:
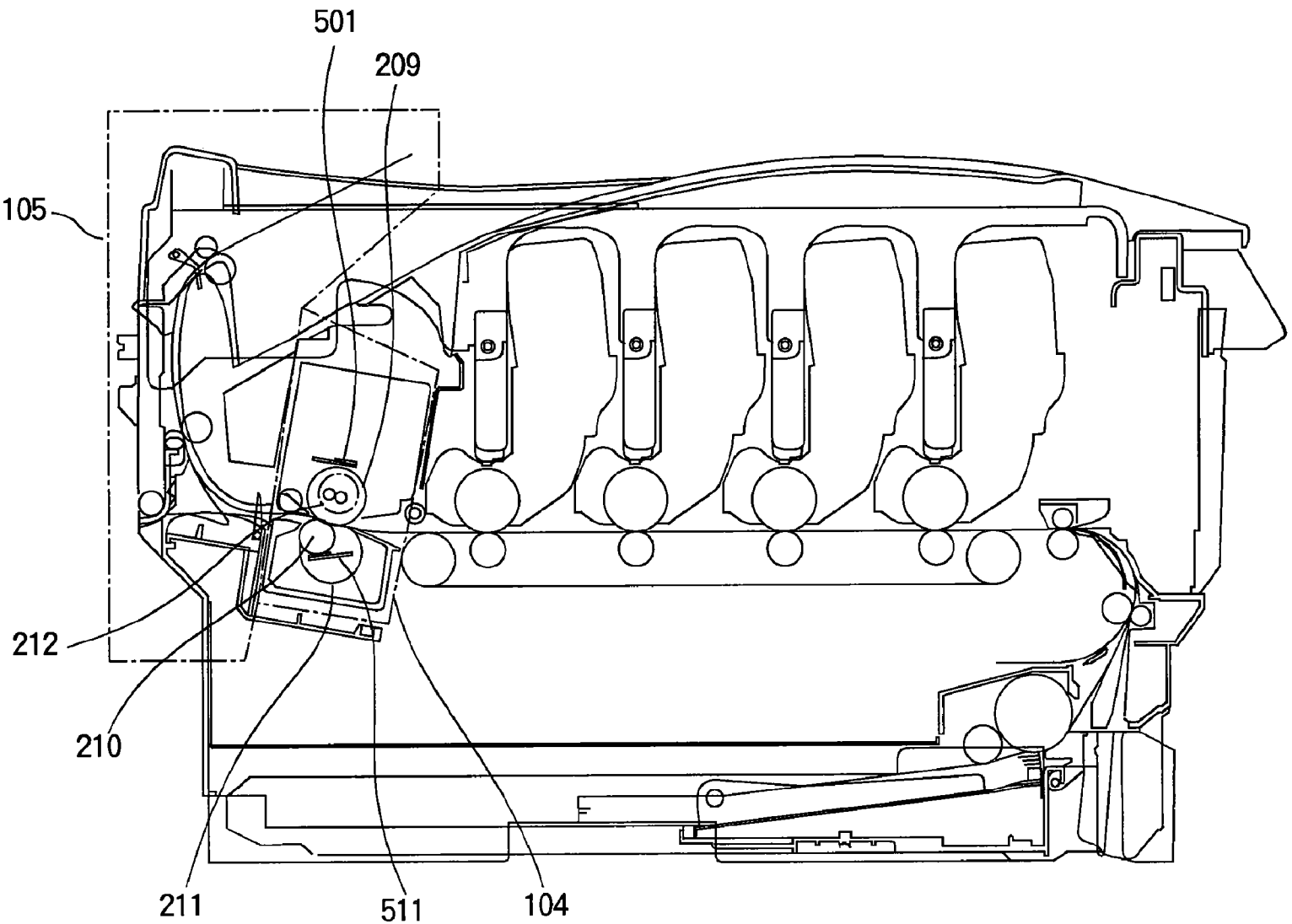
FIG. 23 is a general configuration of an image forming apparatus of a fifth embodiment.

FIG. 23 is a general configuration of an image forming apparatus of the fifth embodiment. This image forming apparatus differs from the image forming apparatus of the first embodiment in that a pressure thermistor 511 is disposed on the inside of the fixing belt 211 for detecting the temperature of the pressure roller 210.

Figure 24:
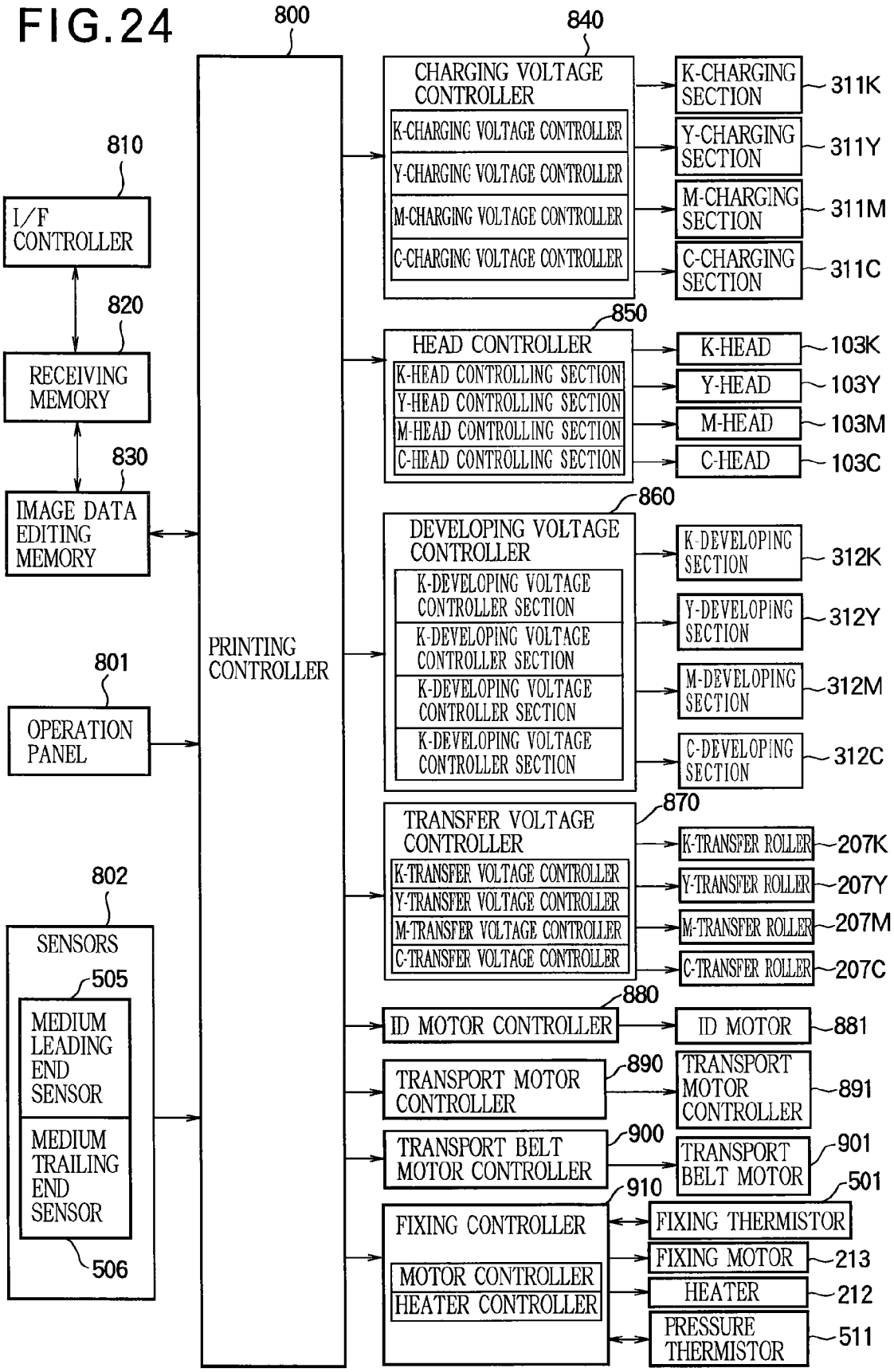
FIG. 24 is a block diagram illustrating the configuration of a controller that controls the pertinent portion of the fifth embodiment.

FIG. 24 is a block diagram illustrating the configuration of a controller that controls the pertinent portion of the fifth embodiment. The image forming apparatus of the fifth embodiment differs from that of the first embodiment in that the pressure thermistor 511 is additionally used, and in that the operation related to the pressure thermistor 511 is involved. Elements similar to those of the first embodiment have been given the same reference numerals and the description thereof is omitted. The pertinent portion of the image forming apparatus is the same as that of the first embodiment. Thus, a description will be given with reference to FIG. 1.

Referring to FIG. 24, a printing controller 800 receives control commands and print data from a host apparatus through an I/F controller 810. Upon receiving a print command, the printing controller 800 determines the circumferential speed V, fixing temperature T, and rotation time tr according to the received print information.

In the fifth embodiment, for a recording medium of a grammage of 70 g/m$^2$, printing conditions are set as follows:

An appropriate circumferential speed V (i.e., printing speed) may be selected from among V51=180 mm/sec, V52=155 mm/sec, V53=120 mm/sec, and V54=95 mm/sec.

An appropriate fixing temperature T may be selected from among T51=190° C., T52=185° C., T53=177° C., and T54=170° C.

An appropriate rotation time tr may be selected in accordance with the temperature Tp of the pressure roller. In other words, for 90° C.≦Tp<Tp<Tb1 (e.g., threshold Tb1=110° C.), the rotation time tr is selected from tr1*b*=13 sec, tr2*b*=10.5 sec, tr3*b*=9 sec, and tr4*b*=6.5 sec. For Tb1≦Tp<Tp<Tb2 (threshold Tb2=130° C.), the rotation time tr is selected from tr1*c*=14 sec, tr2*c*=11.2 sec, tr3*c*=9.5 sec, and tr4*c*=6.8 sec. For Tp≦Tb2, the rotation time tris selected from tr51=15 sec, tr52=12 sec, tr53=10 sec, and tr54=7 sec.

Figure 25:
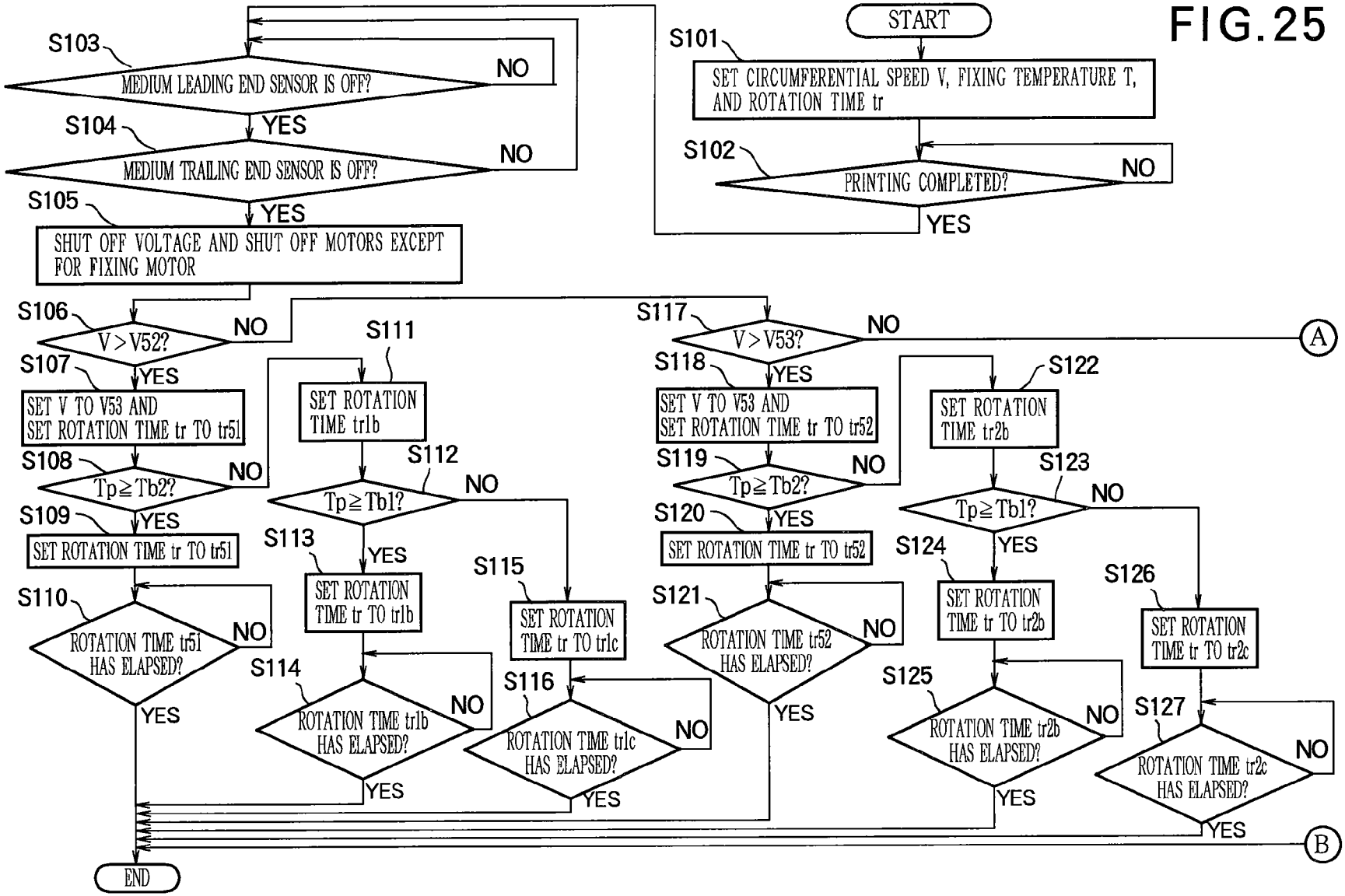
FIG. 25 is a first portion of a flowchart.
Figure 26:
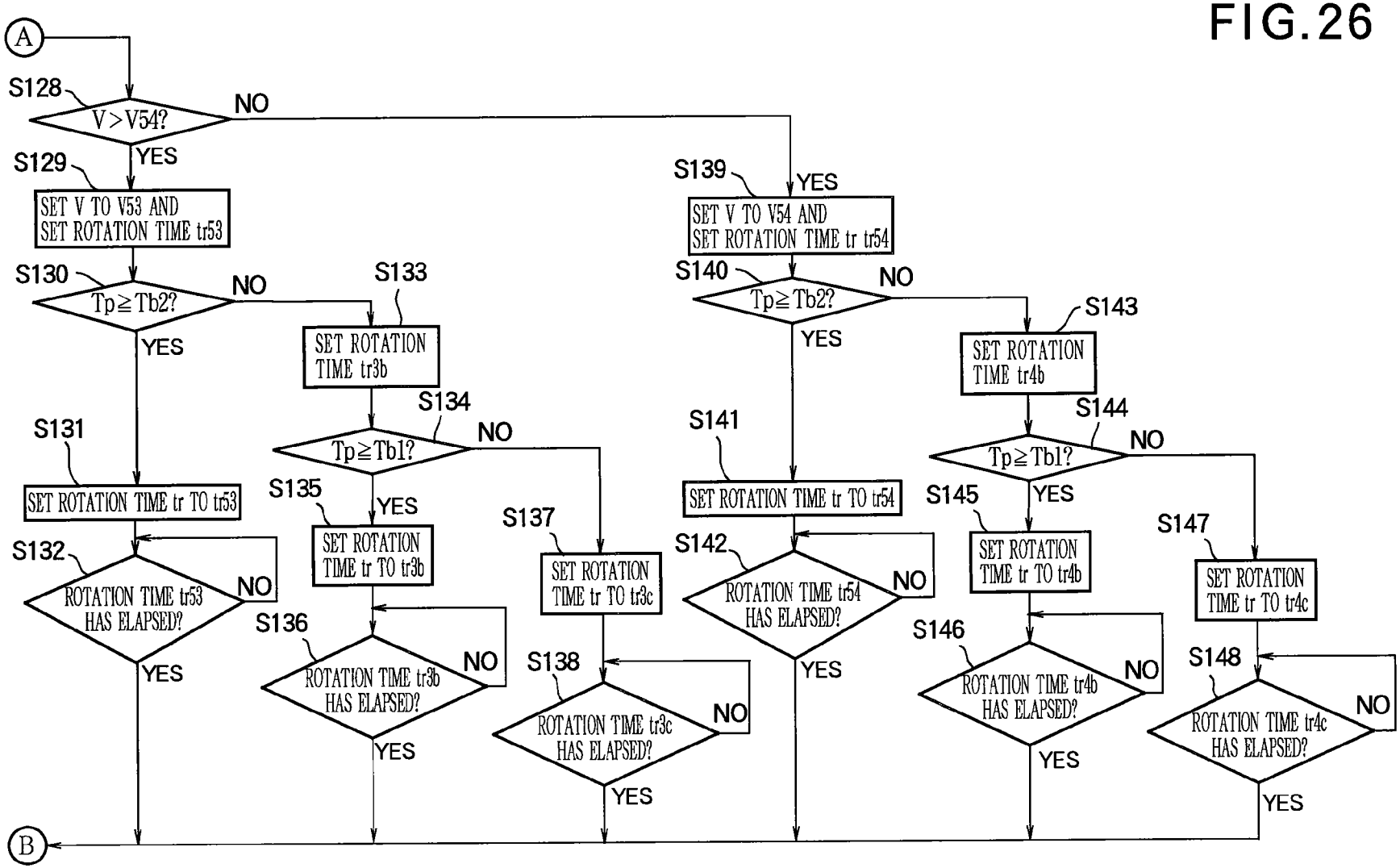
FIG. 26 is a second portion of the flowchart.

The operation of the image forming apparatus of the aforementioned configuration will be described with reference to FIGS. 25 and 26. FIG. 25 is a first portion of a flowchart and FIG. 26 is a second portion of the flowchart.

Step S101: The printing controller 800 receives the control commands and print data from the host apparatus via the I/F controller 810. Upon receiving a print command from the host apparatus, the printing controller 800 checks the received print information to detect the circumferential speed V (i.e., printing speed), the fixing temperature T. Optimum values of circumferential speed V, fixing temperature T, and rotation time tr are selected from among V51-V54, T51-T54, and tr51-tr54. The four different values of circumferential speed V, four different values of fixing temperature T, and three types of rotation times tr51-tr54, tr1*b*-tr4*b*, and tr1*c*-tr4*c* are available for paper of a grammage of 70 g/m$^2$, and are listed in a table stored in a memory of the printing controller 800. These values are selected depending on the environment in which the apparatus operates.

The printing conditions are set, normal printing is performed until it is determined at step S102 that printing has been completed. The printing is carried out in exactly the same manner as that after step S1 of FIG. 4, and therefore the description thereof is omitted. However, based on the detected circumferential speed V and fixing temperature T, the printing controller 800 sends a command to the fixing controller 910, which in turn detects the temperatures in the fixing unit 104 based on the fixing thermistor 501 and pressure thermistor 511, thereby determining whether the fixing unit 104 is within the temperature range in which fixing may be performed normally.

Step S102: After step S101 where the printing conditions are set, a check is made to determine whether printing has been completed. If NO, normal printing is performed until it is determined at step S102 that all of the pages have been printed. If YES, the program proceeds to step S103.

Steps S103-S104: A check is made based on the medium leading end sensor 505 and medium trailing end sensor 506 to determine whether the recording medium is remaining within the discharging unit 105. If YES at steps S103-S104, the program proceeds to step S105.

Step S105: The high voltages supplied to the charging sections 311K, 311Y, 311M, and 311C, the developing sections 312K, 312Y, 312M, and 312C, the transfer rollers 207K, 207Y, 207M, and 207C, and the electric power supplied to the heater 212 are shut off, and the motors except for the fixing motor 213 are shut off.

The medium leading end sensor 505 and the medium trailing end sensor 506 continue to generate detection signals when the recording medium is passing by these sensors. Therefore, when the trailing end of the recording medium has advanced past the medium trailing end sensor 506, it is determined at steps S103-S104 that no recording medium is remaining in the discharging unit 105.

Step S106: A check is made to determine whether the circumferential speed V is higher than a predetermined threshold V52. If V>V52 (YES at S106), then the program proceeds to step S107. If V>V52≦ (NO at S106), then the program proceeds to step S117.

Step S107: The circumferential speed V is set to V53 and the rotation time tr is set to tr51.

Step S108: A check is made to determine whether the temperature Tp detected by the pressure thermistor 511 is not lower than the threshold Tb2. If Tp≧Tb2 (YES at S108), the program proceeds to step S109. If Tp<Tb2 (NO at S108), the program proceeds to step S111.

Step S109: The rotation time tr is set to tr51.

Step S110: The fixing motor 213 is rotated for tr=tr51 and is then shut off.

Step S111: The rotation time tr is set to tr=tr1*b*.

Step S112: A check is made to determine whether the temperature Tp of the fixing roller detected by the pressure thermistor 511 is not lower than the threshold Tb1 (i.e., whether Tp≧Tb1). If YES, the program proceeds to step S113; if NO, the program proceeds to step S115.

Step S113: The rotation time tr is set to tr=tr1*b*.

Step S114: The fixing motor 213 is rotated for tr=tr1*b* and is then shut off.

Step S115: The rotation time tr is set to tr=tr1*c*.

Step S116: The fixing motor 213 is rotated for tr=tr1*c* and is then shut off.

Step S117: A check is made to determine whether the circumferential speed V is higher than a predetermined threshold V53. If V>V53 (YES at S117), then the program proceeds to step S118. If NO, the program proceeds to step S128.

Step S118: The circumferential speed V is set to V53 and the rotation time tr is set to tr52.

Step S119: A check is made to determine whether the temperature Tp of the fixing roller detected by the pressure thermistor 511 is not lower than the threshold Tb2 (i.e., Tp≧Tb2) . IfYES, the program proceeds to step S120; if NO, the program proceeds to step S122.

Step S120: The rotation time tr is set to tr=tr52.

Step S121: The fixing motor 213 is rotated for trt=tr52 and is then shut off.

Step S122: The rotation time tr is set to tr=tr2*b*.

Step S123: A check is made to determine whether the temperature Tp of the fixing roller detected by the pressure thermistor 511 is not lower than the threshold Tb1 (i.e., whether Tp≧Tb1). If YES, the program proceeds to step S124; if NO, the program proceeds to step S126.

Step S124: The rotation time tr is set to tr=tr2*b*.

Step S125: The fixing motor 213 is rotated for tr=tr2*b* and is then shut off.

Step S126: The rotation time tr is set to tr=tr2*c*.

Step S127: The fixing motor 213 is rotated for tr=tr2*c* and is then shut off.

Step S128: A check is made to determine whether the circumferential speed V is higher than a predetermined threshold V54. If V>V54 (YES at S128)j, then the program proceeds to step S129. If NO, the program proceeds to step S139.

Step S129: The circumferential speed V is set to V53 and the rotation time tr is set to tr53.

Step S130: A check is made to determine whether the temperature Tp detected by the pressure thermistor 511 is not lower than the threshold Tb2. If Tp≧Tb2 (YES at S130), the program proceeds to step S131. If Tp<Tb2 (NO at S130), the program proceeds to step S133.

Step S131: The rotation time tr is set to tr53.

Step S132: The fixing motor 213 is rotated for tr=tr53 and is then shut off.

Step S133: The rotation time tr is set to tr=tr3*b*.

Step S134: A check is made to determine whether the temperature Tp detected by the pressure thermistor 511 is not lower than the threshold Tb1. If Tp≧Tb1 (YES at S134), the program proceeds to step S135. If Tp<Tb1 (NO at S134), the program proceeds to step S137.

Step S135: The rotation time tr is set to tr3*b*.

Step S136: The fixing motor 213 is rotated for tr=tr3*b* and is then shut off.

Step S137: The rotation time tr is set to tr3*c*.

Step S138: The fixing motor 213 is rotated for tr=tr3*c* and is then shut off.

Step S139: The circumferential speed V is set to V54 and the rotation time tr is set to tr54.

Step S140: A check is made to determine whether the temperature Tp detected by the pressure thermistor 511 is not lower than the threshold Tb2. If Tp≧Tb2 (YES at S140), the program proceeds to step S141. If Tp<Tb2 (NO at S140), the program proceeds to step S143.

Step S141: The rotation time tr is set to tr54.

Step S142: The fixing motor 213 is rotated for tr=tr54 and is then shut off.

Step S143: The rotation time tr is set to tr=tr4*b*.

Step S144: A check is made to determine whether the temperature Tp detected by the pressure thermistor 511 is not lower than the threshold Tb1. If Tp≧Tb1 (YES at S144), the program proceeds to step S145. If Tp<Tb1 (NO at S144), the program proceeds to step S147.

Step S145: The rotation time tr is set to tr4*b*.

Step S146: The fixing motor 213 is rotated for tr=tr4*b* and is then shut off.

Step S147: The rotation time tr is set to tr4*c*.

Step S148: The fixing motor 213 is rotated for tr=tr4*c* and is then shut off.

Table 4 lists circumferential speeds V, corresponding fixing temperatures, and rotation times tr51-tr54 and tr1*s*-tr4*s*, which are set at step S101. The rotation times are selected from either tr51-tr54, tr1*b*-tr4*b*, or tr1*c*-tr4*c* depending on the temperature Tp detected by the pressure thermistor 511.

TABLE 4

| Circumferential speed V (mm/sec) | Fixing temp. T (° C.) | Cooling time tr | | |
|---|---|---|---|---|
| | | Tp ≧ Tb2 | Tb1 ≦ Tp < Tb2 (sec) | Tp < Tb1 |
| V51 | T51 | tr51 | tr1b | tr1c |
| V52 | T52 | tr52 | tr2b | tr1c |
| V53 | T53 | tr53 | tr3b | tr1c |
| V54 | T54 | tr54 | tr4b | tr1c |

As is clear from FIGS. 25 and 26, the fixing temperatures T51-T54 where T51>T52>T53>T54 are selectively set in correspondence with the printing speeds V51-V54 where V51>V52>V53>V54. Additionally, an optimum rotation time is selected from among a plurality of rotation times tr for each combination of printing speed V and fixing temperature T.

The fifth embodiment has been described with respect to a case in which the rotation time tr is selected from among values divided into three ranges. However, the present invention is not limited to this. For example, the values of the rotation time may be divided in any number of ranges. Still alternatively, the rotation time may be computed individually based on the temperature of the pressure roller. While the pressure thermistor 511 is provided on the inside of the fixing belt, the pressure thermistor may be disposed on the outer surface of the fixing belt or interior of the pressure roller as long as the temperature of the pressure roller can be detected properly.

Just as in the first embodiment, the fixing motor 213 is rotated at a lower speed after the recording medium has passed the fixing unit 104 than when the recording medium is passing the fixing unit 104. Then, the rotation time is increased in small increments according to the circumferential speed, fixing temperature, and the temperature of the pressure roller such that a shortest possible rotation time is achieved. In this manner, the noise generated after the recording medium has left the fixing unit may be reduced by not only reducing the circumferential speed after the recording medium has left the fixing unit 104 but also shortening the rotation time of the fixing motor in accordance with the temperature of the pressure roller. This provides a quiet working environment to the user.

Sixth Embodiment

Figure 27:
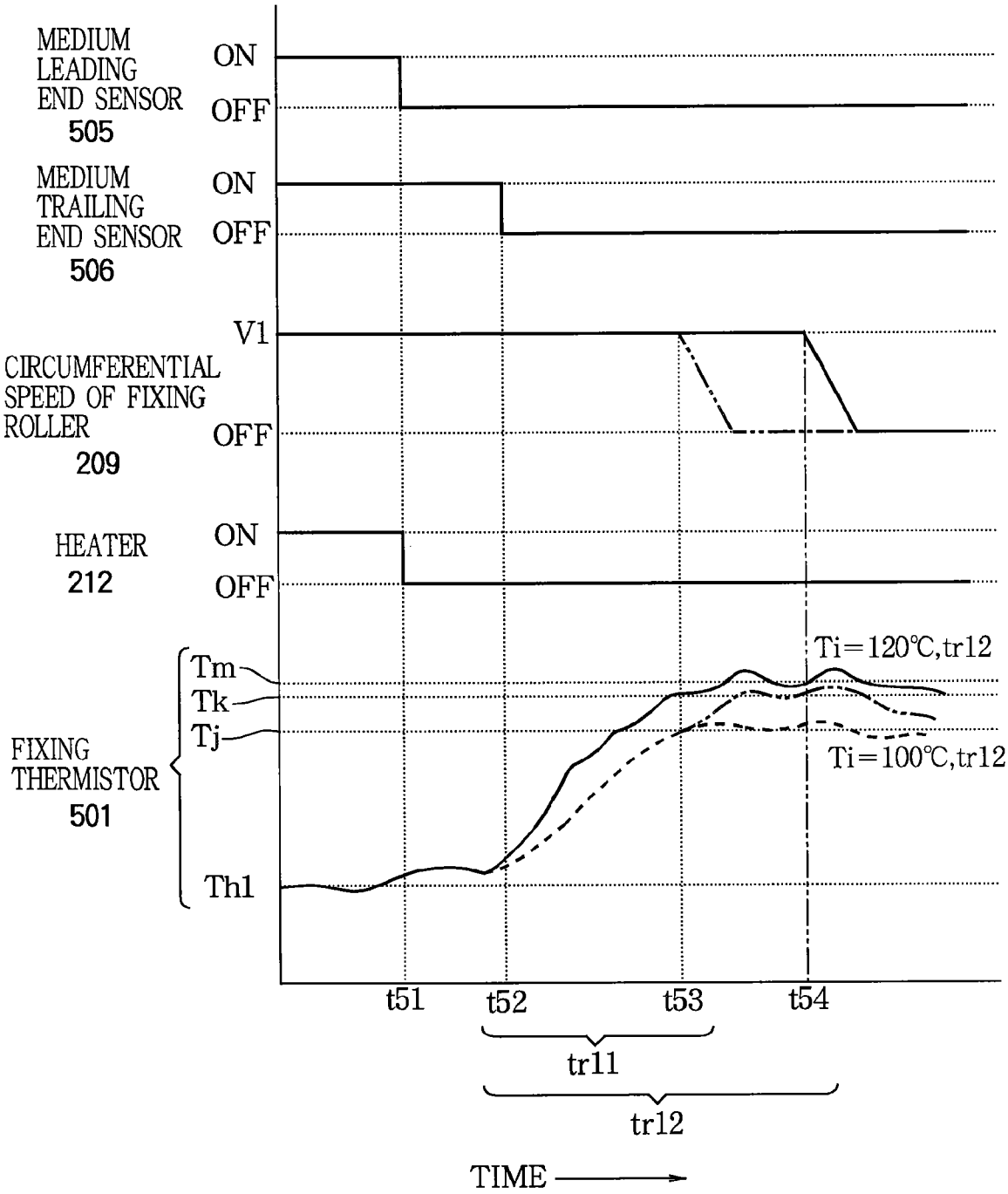
FIG. 27 is a graph illustrating the effects of the temperature of an atmosphere surrounding a fixing roller and a pressure roller on the fixing roller after a recording medium has passed through a fixing unit.

FIG. 27 is a graph illustrating the effects of the temperature of an atmosphere surrounding a fixing roller 209 and a pressure roller 210 on the fixing roller 209 after a recording medium has passed through a fixing unit 104. With a circumferential speed V of the fixing roller V=190 mm/sec, a fixing temperature T=190° C., and a rotation time tr=15 sec, an overshoot caused a maximum temperature of the fixing roller to reach Tm (e.g., 230° C.) when the temperature T1 of the inner atmosphere of the fixing unit 104 (i.e., the temperature of the atmosphere surrounding the fixing roller 209 and the pressure roller 210) was Ti=120° C., and Tj (e.g., 215° C.) when the temperature Ti of inner atmosphere was Ti-100° C. Because the cooling efficiency of the fixing roller 209 greatly depends on the atmosphere surrounding the fixing roller 209 and the pressure roller 210, the overshoot of the temperature of the fixing roller 209 greatly varies. Thus, a sixth embodiment employs a means for detecting the temperature of the inner atmosphere Ti, and efficiently sets the rotation time tr in accordance with the temperature of the inner atmosphere.

Figure 28:
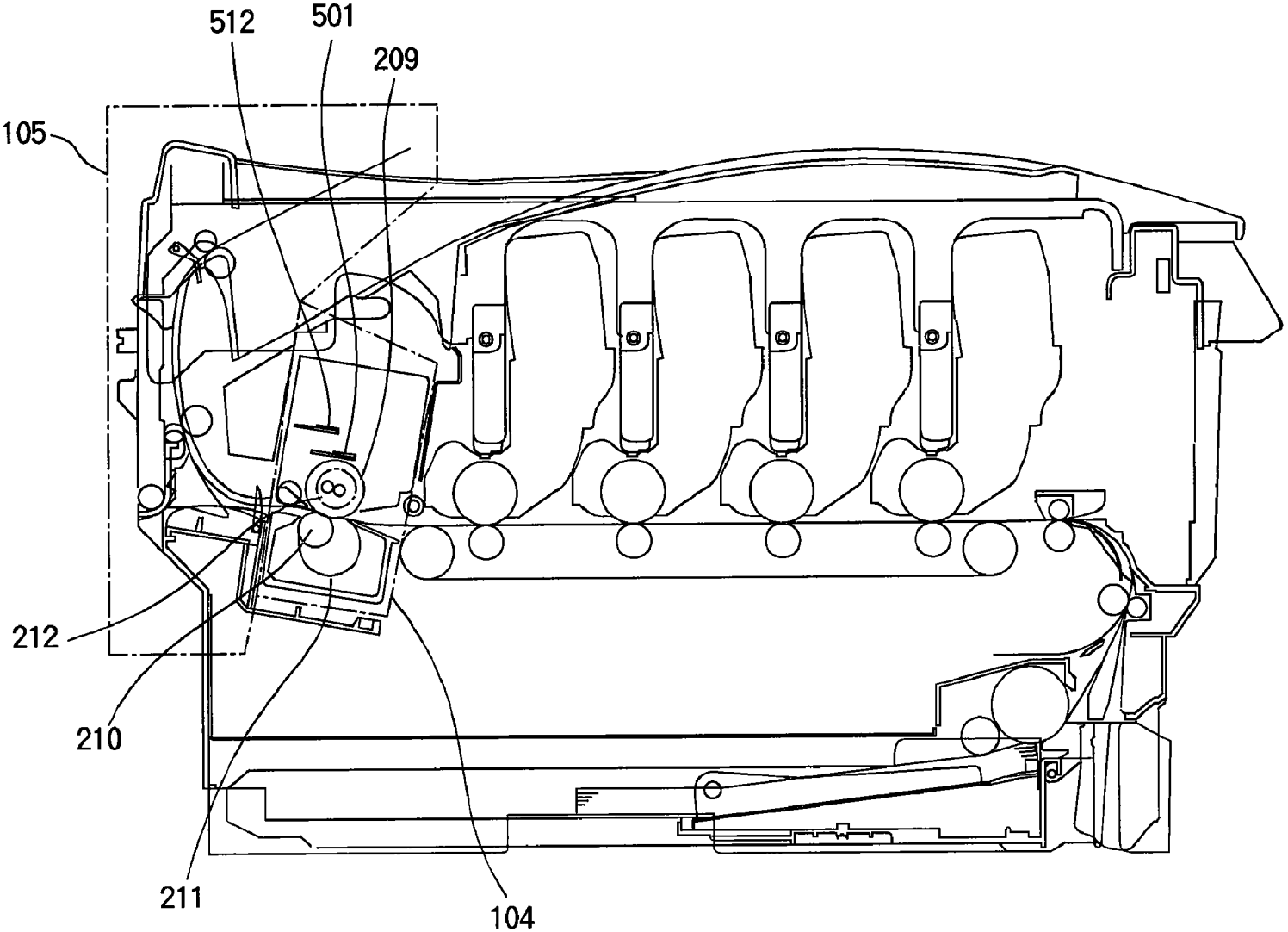
FIG. 28 is a front view illustrating a pertinent portion of an image forming apparatus of a sixth embodiment.

FIG. 28 is a front view illustrating a pertinent portion of an image forming apparatus of the sixth embodiment. The image forming apparatus differs from that of the first embodiment in that a compensation thermistor 512 is disposed in a fixing unit 104 above the fixing thermistor 501 and detects the temperature of the inner atmosphere to compensate for the fixing temperature.

Figure 29:
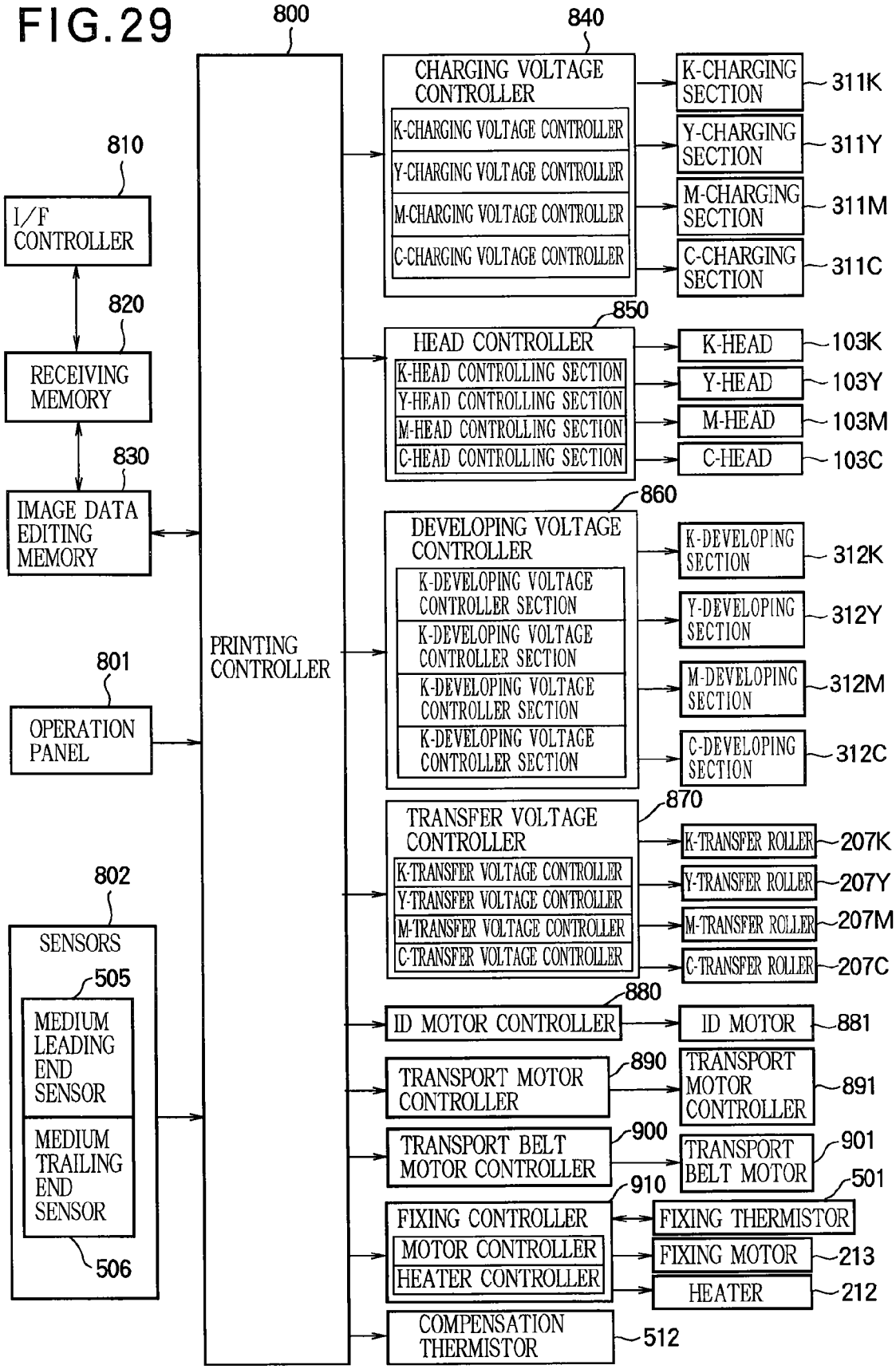
FIG. 29 is a block diagram illustrating a pertinent portion of a control system of the image forming apparatus of the sixth embodiment.

FIG. 29 is a block diagram illustrating a pertinent portion of a control system of the image forming apparatus of the sixth embodiment. The control system of the sixth embodiment differs from that of the first embodiment in that the compensation thermistor 512 is added and the operation involves the compensation thermistor 512. Elements similar to those of the first embodiment have been given the same reference numerals and the description thereof is omitted.

Referring to FIG. 29, a printing controller 800 receives control commands and print data from a host apparatus via an I/F controller 810. Upon receiving a print command from the host apparatus, the printing controller 800 determines based on the received print information a circumferential speed V of the fixing roller, a fixing temperature T, and a rotation time tr.

In the sixth embodiment, for paper having a grammage of 70 g/m$^2$, appropriate printing conditions are set as follows:

An appropriate circumferential speed V may be selected from among V61=180 mm/sec, V62=155 mm/sec, V63=120 mm/sec, and V64=95 mm/sec.

An appropriate fixing temperature T may be selected from among T61=190° C., T62=185° C., T63=177° C., and T64=170° C.

Further, a threshold Tc of the temperature of inner atmosphere Ti is provided. If the interior temperature Ti is below the threshold Tc, then the rotation time may be shortened. The threshold Tc is selected to be Tc=110° C. The rotation time tr when the temperature of inner atmosphere Ti is below the threshold Tc may be selected from among tr1*s*=14 sec, tr2*s*=11 sec, tr3*s*=9 sec, and tr4*s*=8 sec. The rotation time tr when the temperature of inner atmosphere Ti is not lower than the threshold Tc may be selected from among tr61=15 sec. tr62=12 sec, tr63=10 sec, and tr64=7 sec.

Figure 30:
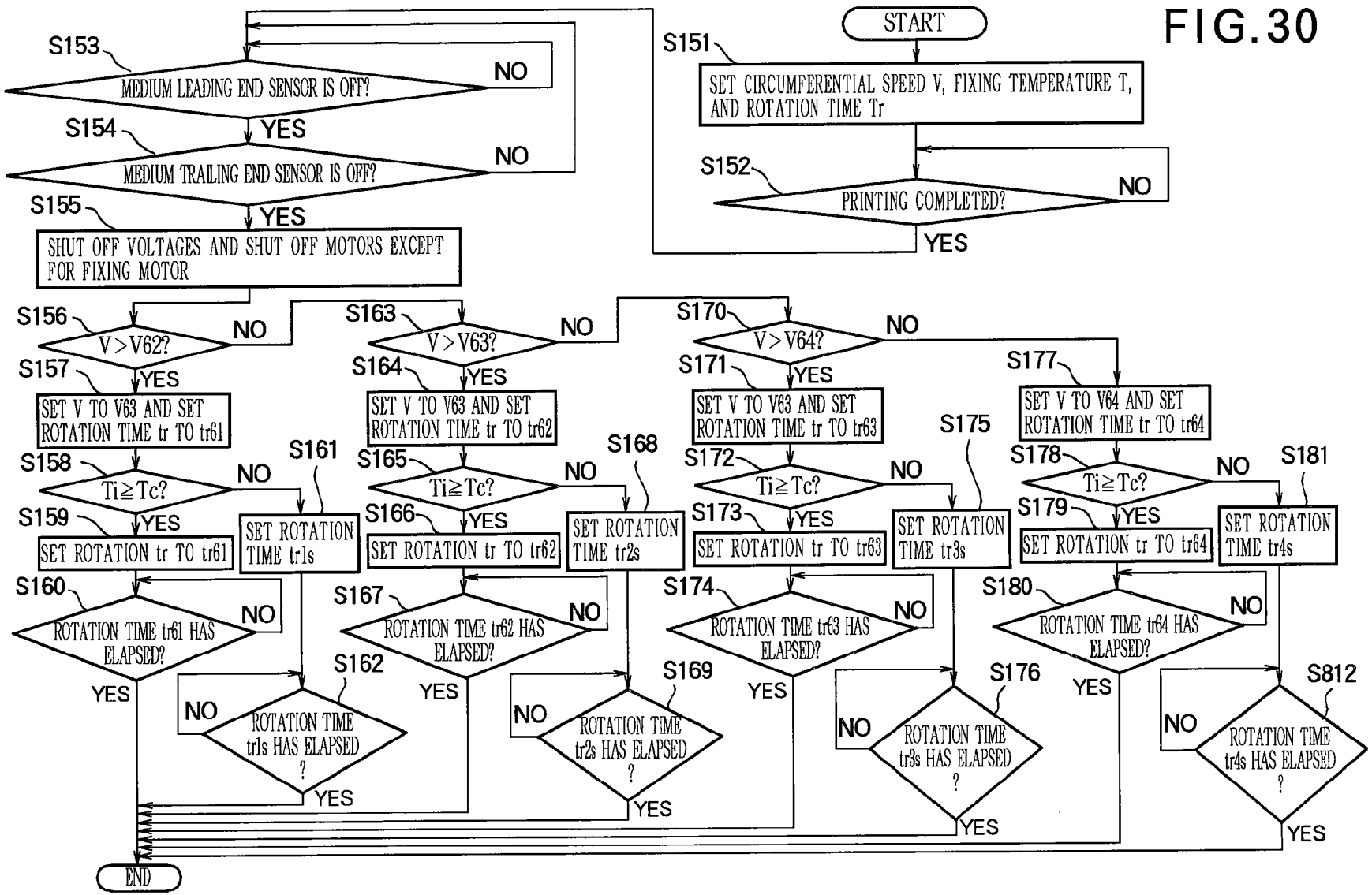
FIG. 30 illustrates the operation of the image forming apparatus of the sixth embodiment.
Figure 31:
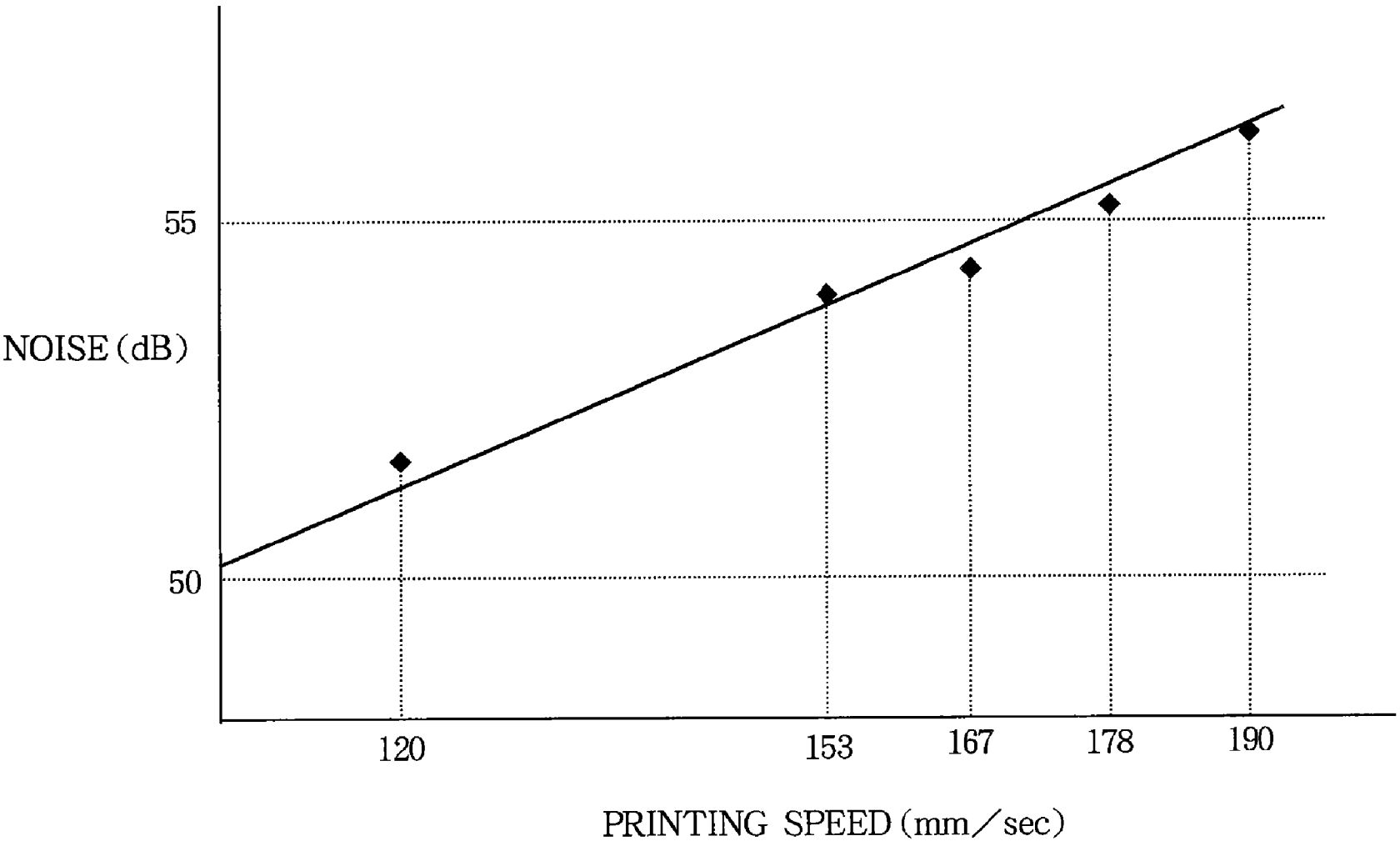
FIG. 31 illustrates the relation between printing speed and noise generated during printing in a conventional apparatus.

FIG. 30 illustrates the operation of the image forming apparatus of the sixth embodiment. The operation of the image forming apparatus of the aforementioned configuration will be described with reference to FIG. 30.

Step S151: The printing controller 800 receives the control commands and print data from the host apparatus via the I/F controller 810. Upon receiving a print command from the host apparatus, the printing controller 800 checks the received print information to detect the circumferential speed V, the fixing temperature T, and the rotation time tr. Optimum values of the circumferential speed V, fixing temperature T, and rotation time tr are selected from among V61-V64, T61-T64, and tr61-tr64, respectively. The four different values of the circumferential speed V, four different values of the fixing temperature T, four different values of the rotation time tr61-tr64, and four different values of rotation time tr1*s*-tr4*s* are available for paper of a grammage of 70 g/m$^2$, depending on the environment in which the apparatus operates, and are listed in a table stored in a memory of the printing controller 800.

After step S151 where the printing conditions are set, normal printing is performed until it is determined at step S152 that printing has been completed. The printing is carried out in exactly the same manner as that after step S1 of FIG. 4, and therefore the description thereof is omitted. The printing controller 800 sends a command to the fixing controller 910, which in turn determines the temperature of the fixing unit 104 (FIG. 28) based on the outputs of the fixing thermistor 501 and the compensation thermistor 512, thereby determining whether the temperature of the fixing roller 209 is within the range in which fixing may be performed.

Step S152: A check is made to determine whether printing has been completed. If NO, printing is carried out at the circumferential speed V and the fixing temperature T. If YES, the program proceeds to step S153.

Steps S53-S54: A check is made based on the outputs of the medium leading end sensor 505 and the medium trailing end sensor 506 to determine whether the recording medium remains in the discharging unit 105.

Step S155: If YES at steps S153 and S154, the high voltages supplied to the charging sections 311K, 311Y, 311M, and 311C, the developing sections 312K, 312Y, 312M, and 312C, the transfer rollers 207K, 207Y, 207M, and 207C, and the electric power supplied to the heater 212 are shut off, and the motors except for the fixing motor 213 are shut off.

The medium leading end sensor 505 and the medium trailing end sensor 506 continue to generate detection signals when the recording medium is passing by these sensors. Therefore, when the trailing end of the recording medium has advanced past the medium trailing end sensor 506, it is determined at steps S153-S154 that no recording medium is remaining in the discharging unit 105.

Step S156: A check is made to determine whether the circumferential speed V is higher than a predetermined threshold V62. If V>V62 (YES at S156), then the program proceeds to step S157.

Step S157: The circumferential speed V is set to V63 and the rotation time tr is set to tr61.

Step S158: A check is made to determine whether the temperature of the inner atmosphere Ti is not lower than the threshold Tc. If Ti≧Tc (YES at S158), the program proceeds to step S159. If NO (i.e., Ti<Tc), the program proceeds to step S161.

Step S159: The rotation time tr is set to tr61.

Step S160: The fixing motor 213 is rotated for tr=tr61 and is then shut off.

Step S161: The rotation time tr is set to tr=tr1*s*.

Step S162: The fixing motor 213 is rotated for tr=tr1*s* and is then shut off.

Step S163: If the answer is NO at step S156 (i.e., V≦V62), a check is made to determine whether the circumferential speed V is greater than the threshold V63. If YES, the program proceeds to step S164. If NO, the program proceeds to step S170.

Step S164: The circumferential speed V is set to V63 and rotation time tr is set to tr=tr62.

Step S165: A check is made to determine whether the temperature of the inner atmosphere Ti is not lower than the threshold Tc. If YES, the program proceeds to step S166.

Step S166: The rotation time tr is set to tr=tr62.

Step S167: The fixing motor 213 is rotated for tr=tr62 and is then shut off.

Step S168: The rotation time tr is set to tr=tr2*s*.

Step S169: The fixing motor 213 is rotated for tr=tr2*s* and is then shut off.

Step S170: If the answer is NO at step S163 (i.e., V≦V63) a check is made to determine whether the circumferential speed V is greater than the threshold V64. If YES, the program proceeds to step S171. If NO, the program proceeds to step S177.

Step S171: The circumferential speed V is set to V63 and rotation time tr is set to tr=tr63.

Step S172: A check is made to determine whether the temperature of the inner atmosphere Ti is not lower than the threshold Tc. If YES, the program proceeds to step S173. If NO, the program proceeds to step S175.

Step S173: The rotation time tr is set to tr=tr63.

Step S174: The fixing motor 213 is rotated for tr=tr63 and is then shut off.

Step S175: The rotation time tr is set to tr=tr3*s*.

Step S176: The fixing motor 213 is rotated for tr=tr3*s* and is then shut off.

Step S177: The circumferential speed V is set to V64 and rotation time tr is set to tr=tr64.

Step S178: A check is made to determine whether the temperature of the inner atmosphere Ti is not lower than the threshold Tc. If YES, the program proceeds to step S179. If NO, the program proceeds to step S181.

Step S179: The rotation time tr is set to tr=tr64.

Step S180: The fixing motor 213 is rotated for tr=tr64 and is then shut off.

Step S181: The rotation time tr is set to tr=tr4*s*.

Step S182: The fixing motor 213 is rotated for tr=tr4*s* and is then shut off and the program ends.

Table 5 lists motors speeds V61-V64, corresponding fixing temperatures T61-T64, and rotation times tr61-tr64 and Tr1*s*-Tr4*s*, which are set at step S151. The rotation times are selected from either tr61-tr64 or tr1*s*-tr4*s* depending on the temperature of the inner atmosphere Ti.

TABLE 5

| Circumferential speed V mm/sec | Fixing temp. T ° C. | Cooling time tr Ti ≧ Tc (sec) | Cooling time tr Ti < Tc (sec) |
|---|---|---|---|
| V61 | T61 | tr61 | tr1s |
| V62 | T62 | tr62 | tr2s |
| V63 | T63 | tr63 | tr3s |
| V64 | T64 | tr64 | tr4s |

As is clear from the flowchart in FIG. 30, the fixing temperatures T61-T64 (T61>T62>T63>T64) and corresponding circumferential speeds V61-V64 (V61>V62>V63>V64) are selectively set. Additionally, a rotation time tr necessary for the temperature of the fixing roller not to exceed the abnormal temperature Ta is selected in accordance with the temperature of the inner atmosphere Ti.

In the sixth embodiment, the fixing temperature T, motor speed V, and rotation time tr are set at step S151. The rotation time tr is not necessary to be set at step S151 because the rotation time tr is set at a later time. The rotation time tr is selected from values in two ranges of the temperature of the inner atmosphere Ti. Alternatively, the rotation time tr may be selected from values in a plurality of ranges of the temperature of the inner atmosphere Ti.

Just as in the first embodiment, the fixing motor is rotated at a lower speed after the recording medium has passed the fixing unit 104 than when the recording medium is passing through the fixing unit 104. Then, the rotation time is increased in small increments according to the circumferential speed V, fixing temperature T, and temperature of the inner atmosphere Ti such that a shortest possible rotation time tr is achieved. In this manner, the noise generated after the recording medium has left the fixing unit may be reduced by not only reducing the circumferential speed but also by shortening the rotation time of the fixing motor. This provides a quiet working environment to the user.

In the aforementioned first to sixth embodiments, the presence and absence of the recording medium in the discharge unit 105 are detected based on the outputs of the medium leading end sensor 505 and medium trailing end sensor 506. The length of the recording medium may be determined either by the user prior to the printing operation or based on the time for at least one of the medium leading end sensor 505 and medium trailing end sensor 506 to remain ON. Thus, the time required for the recording medium to be completely discharged from the discharging unit 105 may be predicted. This implies that a single sensor may be enough to detect the presence and absence of the recording medium in the discharging unit 105.

The present invention has been described in terms of an LED tandem type color electrophotographic printer. The invention may also be applicable to other image forming apparatuses such as a laser type image forming apparatus and an intermediate transfer type image forming apparatus. While the embodiments have been described in terms of a belt type fixing device, the present invention may also be applicable to a roller type fixing device and an induction heating type (IH type) fixing device. While the invention has been described with respect to a case in which a fixing device and a discharging device are driven by the same drive source, the invention may also be applicable to image forming apparatuses in which a fixing device and a discharging device are driven by separate drive sources or in which a fixing device and a medium feeding mechanism are driven by the same drive source.

The detector for detecting an environmental temperature in the fourth embodiment has been described in terms of a thermistor disposed within the image forming apparatus. The invention may be applicable to an image forming apparatus in which a thermistor disposed outside of the image forming apparatus, or in which temperature information may be obtained from an external apparatus such as a separate personal computer or an infrared sensor via a communication device.

In the first to sixth embodiments, the motor 213 is controlled to rotate at a reduced speed in relation to the speed during fixing after the last page of a plurality of pages specified by a printing command has advanced past the medium leading end sensor 505. The present invention is not limited to this. The motor 213 may be controlled to rotate at a reduced speed in relation to the speed during fixing after the last page of a plurality of pages specified by a printing command has advanced past the medium trailing end sensor 506 in the vicinity of a stacker, in which case, the discharge rollers 218 and 220 are preferably driven by a drive source separate from the fixing motor 213 that drives the fixing unit 104.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus, comprising:

a fixing section that fixes an image formed on a recording medium;

a drive section that drives said fixing section in rotation; and a controller that controls a speed at which said drive section drives said fixing section;

wherein when the recording medium is passing through said fixing section, said controller controls said drive section such that said drive section drives said fixing section at a first speed;

wherein when the recording medium has passed through said fixing section, said controller controls said drive section such that said drive section drives said fixing section at a second speed, the second speed being selected in accordance with the first speed; and wherein if the first speed is higher than a reference speed, said controller controls said drive section to drive said fixing section at the second speed lower than the first speed.

2. The image forming apparatus according to claim 1, further comprising a medium transporting section that transports the recording medium after the recording medium has passed said fixing section.

3. The image forming apparatus according to claim 2, wherein said drive section drives said medium transporting section.

4. The image forming apparatus according to claim 1, further comprising a temperature detector that detects a temperature of said fixing section, wherein said controller controls said drive section to drive said fixing section in rotation for an amount of time after the recording medium has passed said fixing section, the time being determined based on either the first speed or the temperature of said fixing section when the recording medium is passing through said fixing section.

5. The image forming apparatus according to claim 4, wherein the second speed is one of a plurality of second speeds, wherein the amount of time is selected to be shorter if a smaller one of the plurality of second speeds is selected.

6. The image forming apparatus according to claim 4, wherein the temperature of said fixing section is one of a plurality of temperatures, wherein the amount of time is selected to be smaller if a lower of the plurality of temperatures is selected.

7. The image forming apparatus according to claim 1, further comprising a temperature detector that detects a temperature of said fixing section, wherein said fixing section includes a fixing member and a pressure member that presses the recording medium against the fixing member;

wherein the image forming apparatus further comprises:

a memory section that stores a first profile of temperature change that describes a temperature of the fixing member with time when said fixing section continues to rotate after the recording medium has passed said fixing section, and a second profile of temperature change that describes a temperature of the fixing member with time when said fixing section stops rotating after the recording medium has passed said fixing section; and an operation section that computes an amount of time for which said controller controls said drive section to drive said fixing section in rotation after the recording medium has left said fixing section, the amount of time being computed based on the first and second profiles and the temperature of said fixing section immediately after the recording medium has passed said fixing section.

8. The image forming apparatus according to claim 7, wherein the first profile and the second profile are characteristics when the image forming apparatus is operated in an environment of a maximum temperature above which the image forming apparatus does not operate normally;

wherein the first profile and the second profile are such that said controller controls said drive section to drive said fixing section for a shorter time with decreasing temperature of the fixing section immediately after the recording medium has passed said fixing section.

9. The image forming apparatus according to claim 1, wherein when the recording medium has passed through said fixing section, said controller shuts off electric power to a heater element of said fixing section.

10. The image forming apparatus according to claim 1, wherein said fixing section includes a fixing member and a pressure member that presses the recording medium against the fixing member, said fixing section includes a detector that detects a temperature of the pressure member;

wherein said controller controls said drive section to drive said fixing section for an amount of time based on the temperature of the pressure member after the recording medium has left said fixing section.

11. The image forming apparatus according to claim 10, wherein said controller controls said drive section to drive said fixing section for a shorter time with decreasing temperature of the pressure member immediately after the recording medium has passed said fixing section.

12. The image forming apparatus according to claim 1, wherein said fixing section includes a fixing member and a first detector that detects a temperature of the fixing member and a second detector that detects a temperature of an inner atmosphere of said fixing section;

wherein said controller controls said drive section to drive said fixing section for an amount of time based on the temperature detected by the second detector.

13. The image forming apparatus according to claim 12, wherein said controller controls said drive section to drive said fixing section for a shorter time with decreasing temperature detected by the second detector immediately after the recording medium has passed said fixing section.

14. The image forming apparatus according to claim 12, wherein the first detector is away from the fixing member.

15. The image forming apparatus according to claim 1, further comprising:

a detector that detects a temperature of an environment in which the image forming apparatus operates;

wherein said controller controls an amount of time for which said controller controls said drive section to drive said fixing section in rotation after the recording medium has passed said fixing section, the amount of time being controlled based on the temperature detected by said detector.

16. The image forming apparatus according to claim 15, wherein the detector that detects a temperature of the environment is disposed below said fixing section in a gravitational direction.

17. The image forming apparatus according to claim 15, wherein the detector that detects a temperature of the environment is disposed upstream of said fixing section with respect to a transport path of the recording medium.

18. The image forming apparatus according to claim 15, wherein the detector that detects a temperature of the environment is disposed within the image forming apparatus and in the vicinity of an air hole formed in an outer housing wall of the image forming apparatus.

19. The image forming apparatus according to claim 15, wherein said controller controls said drive section to drive said fixing section for a shorter time with decreasing temperature of the environment.

20. An image forming apparatus, comprising:

a fixing section that fixes an image formed on a recording medium;

a drive section that drives said fixing section in rotation; and a controller that controls a speed at which said drive section drives said fixing section;

wherein when the recording medium is passing through said fixing section, said controller controls said drive section such that said drive section drives said fixing section at a first speed;

wherein when the recording medium has passed through said fixing section, said controller controls said drive section such that said drive section drives said fixing section at a second speed, the second speed being selected in accordance with the first speed; and wherein said controller controls said drive section to drive said fixing section in rotation for an amount of time after the recording medium has passed said fixing section, the time being determined based on either the first speed or a temperature of said fixing section when the recording medium is passing through said fixing section.

21. An image forming apparatus, comprising:

a fixing section that fixes an image formed on a recording medium;

a drive section that drives said fixing section in rotation; and a controller that controls a speed at which said drive section drives said fixing section;

wherein when the recording medium is passing through said fixing section, said controller controls said drive section such that said drive section drives said fixing section at a first speed;

wherein when the recording medium has passed through said fixing section, said controller controls said drive section such that said drive section drives said fixing section at a second speed, the second speed being selected in accordance with the first speed; and wherein said fixing section includes a fixing member and a pressure member that presses the recording medium against the fixing member, said fixing section includes a detector that detects a temperature of the pressure member;

wherein said controller controls said drive section to drive said fixing section for an amount of time based on the temperature of the pressure member after the recording medium has left said fixing section.

22. An image forming apparatus, comprising:

a fixing section that fixes an image formed on a recording medium;

a medium sensor disposed downstream of said fixing section with respect to a direction in which the recording medium is advanced;

a drive section that drives said fixing section in rotation; and a controller that controls a speed at which said drive section drives said fixing section;

wherein when the recording medium is passing through said fixing section, said controller controls said drive section such that said drive section drives said fixing section at a first speed; and wherein when the recording medium has passed through said medium sensor, said controller controls said drive section such that said drive section drives said fixing section at a second speed, the second speed being selected in accordance with the first speed.

23. The image forming apparatus according to claim 22, wherein said medium sensor detects either a leading end of the recording medium or a trailing end of the recording medium.

24. The image forming apparatus according to claim 23, wherein if the first speed is higher than a reference speed, said controller controls said drive section to drive said fixing section at the second speed lower than the first speed.

25. The image forming apparatus according to claim 23, further comprising a temperature detector that detects a temperature of said fixing section, wherein said controller controls said drive section to drive said fixing section in rotation for an amount of time after the recording medium has passed said fixing section, the time being determined based on either the first speed or the temperature of said fixing section when the recording medium is passing through said fixing section.

26. The image forming apparatus according to claim 23, wherein said fixing section includes a fixing member and a pressure member that presses the recording medium against the fixing member, said fixing section includes a detector that detects a temperature of the pressure member; and wherein said controller controls said drive section to drive said fixing section for an amount of time based on the temperature of the pressure member after the recording medium has left said fixing section.

* * * * *